US009474680B2

(12) United States Patent
Fitzloff

(10) Patent No.: US 9,474,680 B2
(45) Date of Patent: Oct. 25, 2016

(54) THERAPEUTIC APPARATUS

(71) Applicant: Jeffrey Joseph Fitzloff, Maple Plain, MN (US)

(72) Inventor: Jeffrey Joseph Fitzloff, Maple Plain, MN (US)

( * ) Notice: Subject to any disclaimer, the term of this patent is extended or adjusted under 35 U.S.C. 154(b) by 556 days.

(21) Appl. No.: 14/093,506

(22) Filed: Dec. 1, 2013

(65) Prior Publication Data

US 2015/0150750 A1 Jun. 4, 2015

(51) Int. Cl.
*A61H 15/00* (2006.01)
*A61H 1/02* (2006.01)

(52) U.S. Cl.
CPC ..... *A61H 15/00* (2013.01); *A61H 15/0078* (2013.01); *A61H 1/0222* (2013.01); *A61H 1/0292* (2013.01); *A61H 2015/0021* (2013.01); *A61H 2015/0035* (2013.01); *A61H 2201/0192* (2013.01); *A61H 2201/1215* (2013.01); *A61H 2201/1284* (2013.01); *A61H 2201/1463* (2013.01); *A61H 2201/1623* (2013.01); *A61H 2201/1645* (2013.01); *A61H 2201/1654* (2013.01); *A61H 2201/1669* (2013.01)

(58) Field of Classification Search
CPC ..... A61H 15/00; A61H 2015/0021; A61H 1/0222; A61H 1/0292; B65G 13/00; B65G 13/02; B65G 13/11
USPC ..... 198/535, 809, 861.1, 861.2, 807; 193/35 R, 37
See application file for complete search history.

(56) References Cited

U.S. PATENT DOCUMENTS

| | | | |
|---|---|---|---|
| 614,306 | A | 11/1898 | Mason et al. |
| 1,616,065 | A | 2/1927 | Rosenquist |
| 1,638,025 | A | 8/1927 | Everts |
| 2,359,933 | A | 10/1944 | Niblack |
| 2,395,040 | A | 2/1946 | Curtis |
| 2,543,493 | A | 2/1951 | Gaudette et al. |
| 2,577,646 | A | 12/1951 | Cameron |
| 2,657,686 | A | 11/1953 | Brandenfels |
| 2,840,072 | A | 6/1958 | Stearns |
| 3,523,524 | A | 8/1970 | Wilson |
| 3,662,749 | A | 5/1972 | Simjian |

(Continued)

FOREIGN PATENT DOCUMENTS

| | | | |
|---|---|---|---|
| CN | 201718839 | U | 1/2011 |
| DE | 3542968 | A1 | 6/1987 |

(Continued)

*Primary Examiner* — Justine Yu
*Assistant Examiner* — Timothy Stanis
(74) *Attorney, Agent, or Firm* — Michael A. Mochinski

(57) ABSTRACT

A therapeutic apparatus for therapeutically treating an individual, which includes an upper support, a frame for supporting an inner working assembly and attaching thereto lobe and seat lever controls and a switch panel for motor control, and a structural base for supporting the upper support and frame and attaching thereto a leg rest. The inner working assembly includes rightward and leftward segments each having fore and aft lobes connected together by a hinge mechanism and in part by a flexible guide rail and a plurality of roller assemblies each connected to chains to propel the roller assemblies, with the assistance of the motor, over the flexible guide rails. The lobe lever control changes the geometric profile of the flexible guide rails to correspond with the individual's spine, whereas the seat lever control changes the position of an adjustable lower support to allow the roller assemblies to motion the pelvic region upward and downward and inward and outward to effect traction of the spine.

26 Claims, 19 Drawing Sheets

(56) References Cited

U.S. PATENT DOCUMENTS

| | | | | | |
|---|---|---|---|---|---|
| 3,664,333 | A | | 5/1972 | Hill | |
| 3,794,018 | A | | 2/1974 | Repko | |
| 4,011,862 | A | | 3/1977 | Kosiak | |
| 4,178,921 | A | | 12/1979 | Kosiak | |
| 4,412,534 | A | | 11/1983 | Hamabe et al. | |
| 4,699,126 | A | | 10/1987 | Lancaster | |
| 5,054,472 | A | * | 10/1991 | Stefan | A61H 15/0078 601/116 |
| 5,385,531 | A | | 1/1995 | Jover | |
| 5,810,158 | A | * | 9/1998 | Schiesser | B65G 47/268 198/460.1 |
| 6,190,338 | B1 | | 2/2001 | Arndt | |
| 6,681,770 | B1 | | 1/2004 | Dreher | |
| 6,881,195 | B2 | | 4/2005 | Wu | |
| 7,127,757 | B2 | * | 10/2006 | Roberto | A61H 1/0292 5/613 |
| 7,892,190 | B2 | | 2/2011 | Choi et al. | |

FOREIGN PATENT DOCUMENTS

| | | | |
|---|---|---|---|
| FR | 2773708 | A1 | 7/1999 |
| GB | 2143436 | A | 2/1985 |
| NL | 6811807 | A | 2/1969 |

* cited by examiner

THERAPEUTIC APPARATUS

FIELD OF THE INVENTION

The present invention is generally directed to the noninvasive care of the posterior musculoskeletal system and spinal column, primarily being administered by a therapeutic apparatus with personalized control means for adjusting the support contour to adequately accommodate the unique geometric profile of an individual user's back so as to render a comprehensive therapeutic musculoskeletal massage and facilitate traction of the spinal column by the upward and downward and inward and outward sequential motions applied upon the pelvis region.

BACKGROUND OF THE INVENTION

A great segment of today's population suffers from back pain and back disorders, particularly those that may actively engage in athletic endeavors or otherwise participate in strenuous activities. Most people will suffer some form of back disorder at least once in their lifetime. Many back-related aliments and disorders typically originate from bad posture, poor sitting habits, injury, over exertion, or poor physical condition, resulting in muscular aches and pains and/or distortion or misalignment of the natural elongated S-curvature of the spinal column often referred to as vertebral subluxation.

The back comprises two main parts: the back muscles and the spinal column. The back muscles are integrally connected and attached to the spinal column, while the spinal column consists of bones called vertebrae that are connected together by facet joints. Softer disks separate the vertebrae such as to permit the spinal column to move, bend and flex. They also serve as cushions in between the vertebrae and absorb shock and vibration produced by activities such as running and walking. Nerves connecting the brain to various parts of the body make up the spinal cord, which is protected by the vertebrae. Nerves extend away from the spinal cord to various organs and muscles including those in the arms and legs and carry instructional signals from the brain to the muscles, organs, and limbs to permit their proper functionality. Nerves further serve as pain receptors and appropriately transmit pain sensations from different parts of the body to the brain via the spinal cord.

In instances of one suffering from back pain due to vertebral subluxation, for example, the vertebrae are either out of position, not moving properly, or are undergoing degeneration. This frequently leads to a narrowing of the spaces between the bones through which the nerves pass, thus resulting in irritation or impingement of the nerve itself. Consequently, all of the tissues and organs that are fed by those nerves receive distorted instructional signals from the brain to such extent to lose their capacity to function properly and normally.

Since nerves control the muscles and muscles assist in maintaining the proper position of the vertebrae and thus the normal S-curvature shape of the spinal column, muscles have to be considered an integral part of the vertebral subluxation condition. In fact, muscles both affect and are affected by the vertebral subluxation condition. A subluxation of the spinal column can irritate a nerve, the irritated nerve can then cause a muscle to spasm, the muscle undergoing spasm pulls the attached vertebrae further out of position, which in turn further irritates the nerve, resulting in a vicious and continuous cycle of back pain.

There are numerous therapeutic treatment regimens available and known in the art that appropriately address common forms of back pain and disorders, including the vertebral subluxation condition discussed above. Typically in cases of correcting vertebral subluxation, for example, medical practitioners may prescribe a treatment regimen comprising adjustment of the spinal column that involves a quick thrust applied to a vertebra for the purpose of correcting its position, movement or both followed by therapeutic massage, physical therapy, stretching exercises, or strengthening exercises to prevent its reoccurrence and maintain the normal shape and functionally of the spinal column.

In other cases where back pain may originate from irritated or pinched nerves, the medical practitioner may prescribe spinal traction as a form of therapy in which manual or mechanical forces are applied to the body in an attempt to stretch and realign the spine. Therapeutic spinal traction is most often used to address compressive pain. Compressive pain means that there is pressure on one or more nerves in the spine. The goal of traction is to reduce compression in the spinal column, release trapped nerves, hydrate the interstitial tissue surrounding the vertebrae for increased flexibility and mobility of the spinal column, lessen or eliminate muscle spasms and contractures and in turn relieve the back pain. Traction can either be applied manually by a physical therapist who applies a manual force on the muscles and joints to widen the space between vertebrae or by spinal traction devices that incorporate pulleys, ropes, and slings to stretch the spine.

Although the art readily offers numerous forms of therapeutic devices capable of treating back pain and disorders, many are typically directed to treating a singular ailment, such as being mainly directed to alleviating back pain through muscular massage or traction of the spine, but not both in a simultaneous manner. Although back pain and disorders may originate from many sources, such as being muscular based and/or spinal based, it is quite appropriate and quintessential to offer a therapeutic apparatus adaptively suited to or capable of comprehensively treating the musculoskeletal system and spinal column as a collective unit, particularly given the strong physiological and functional interrelationship between the spinal column and surrounding muscular tissue.

Mechanically-based devices of the type appropriately configured as a bed or table that permits an individual user to rest atop thereof to receive a therapeutic massage for resolving back pain and disorders mentioned hereinbefore typically rely on a conveyor arrangement of rollers or a carriage of rollers that is guided on a rail or track assembly and sufficiently driven by a motor. In some configurations that depart from a more linear or planar roller arrangement, the carriage assembly may comprises mechanical provisions that allow the rollers to generally follow and conform to the curvature of the back or spine insofar to apply a more uniform pressure along the entire length of the spine, such as the chiropractic massage table depicted in Steffensmeier, U.S. Pat. No. 5,088,475. Other attempts that provide for adjustability of the massaging device for increased intimate contact with the spine absent traction capabilities include the spinal treatment table shown in Dreher, U.S. Pat. No. 6,681,770. Although each of the two prior art devices exemplify reasonable attempts to render a more complete massage via intimate contact between the rollers and the spine, they, as well as others, inadequately comprise supplemental means for stretching the spine that sufficiently establishes a comprehensive effort to resolve back pain and disorders that originate relatively around and about the spinal column.

Accordingly, there remains a need for a therapeutic apparatus that employs a plurality of massaging rollers having adjustability capabilities to permit an intimate relationship with the spine for increased massaging effect while simultaneously offering an option to stretch the spine in a manner that is more conducive and comprehensive in resolving back pain and disorders that commonly afflict a majority of the population.

BRIEF SUMMARY OF THE INVENTION

In order to overcome the numerous drawbacks apparent in the prior art, a therapeutic apparatus has been devised to comprehensively treat back pain and disorders commonly associated with and relatively originating at and around the spinal column and surrounding muscle tissue.

It is an object of the present invention to provide a therapeutic apparatus that includes lever controls within the immediate reach and under the operation of the individual user to adjust the rate and directional movement of a plurality of roller assemblies and position of an adjustable lower support to effect variation in the level of penetrable massage, particularly in a manner that affords personal comfort to the user.

It is an object of the present invention to provide a therapeutic apparatus that includes a plurality of rollers each being selectively configured in terms of dimension and spatial separation to offer optimum therapeutic pressure along the entire length of the spine for increased stimulation and even application of the massaging effect.

It is a further object of the present invention to provide a therapeutic apparatus that is semi-portable, relatively simple in terms of design and construction, and compartmentalized for increased accessibility for periodic repair and maintenance.

It is a further object of the present invention to provide a therapeutic apparatus that offers a deep penetrable massage in the form of muscle stripping to effectively reduce adhesions (scar tissue) and knots formed in muscle fiber during physical activity, primarily being resolved by the therapeutic push-pull, kneading action on the muscles that sufficiently restores blood flow to the afflicted muscle fiber that accordingly enhances recovery times, prevents future injuries, and increases stride length, flexibility, and strength.

It is yet another object of the present invention to provide a therapeutic apparatus that provides for the upward and downward manipulation of the pelvis region to appropriately stretch the spinal column in a temporary state of traction and alleviate pressure on the sciatica nerve that is typically associated with lower back and leg pain.

It is a further object of the present invention to provide a therapeutic apparatus that permits for the adjustment of the support contour to accommodate the unique geometric profile of the individual user's back so as to render a comprehensive therapeutic musculoskeletal massage.

It is yet a further object of the present invention to provide a therapeutic apparatus that supplements and complements other therapeutic treatments in restoring the spinal S-curvature to its proper configuration, thus relieving or avoiding the uneven pressure on discs and vertebrae that can contribute and cause undue pain and fatigue.

In accordance with the present invention a therapeutic apparatus has been devised for administering therapeutic pressure generally about specific bodily areas designated for treatment, including areas relatively around the spinal column and surrounding muscular tissue, the therapeutic apparatus principally comprising an upper support having an open portion designated for receiving an individual user, a frame of rectangular form for housing therewithin an inner working assembly and attaching externally thereto lobe and seat lever controls and a switch panel, and a structural base with companion downwardly extending legs for supporting the upper support and frame above ground level and attaching thereto a leg rest; the inner working assembly generally comprising a plurality of roller assemblies each having roller shafts with ends connected to internal drive chains to sufficiently propel the roller assemblies, with the assistance of a motor, over and about flexible guide rails generally affixed to perimeter portions of fore and aft lobes of the rightward and leftward segments and a plurality of individual rollers each separated apart from one another along the roller shaft by spacers; the upper support further comprising an inner protective shell for protecting the individual user from the rotatable action of the roller assemblies during therapeutic treatment and a moveable headrest to accommodate the individual user's head; the rightward and leftward segments each comprises a hinge mechanism for connecting together the fore and aft lobes to permit pivoting action thereabout such as to allow each of the lobes to angularly travel and consequently alter the geometric profile of the flexible guide rails; the lobe lever control generally being associated with a number of linkage members pivotally connected to one another to control the extent of leveraging action produced by leveraging arms on the lobes that subsequently alters the geometric travel of the roller assemblies relatively over the flexible guide rails, generally in a manner that coincides with the curvature of the individual user's spine; the seat lever control generally serving to control the positional settings of an adjustable lower support particularly suited to accommodate the individual user's buttock, whereby a lowered, forward positional setting thereof generally shifts the individual user's buttock more toward the moving roller assemblies so as to sequentially motion the pelvic region generally upward and downward and inward and outward for effecting traction of the spinal column; and the switch panel generally comprising a selectable settings panel for forward and reverse operational modes of the motor that accordingly sets the directional travel of the roller assemblies relatively around the segments and a timer switch that sets the time duration for motor operation.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as an apparatus to effect therapeutic massage for the care and treatment of back pain and disorders that originate relatively at and around the spinal column and connected posterior muscular tissue.

Figure 1:
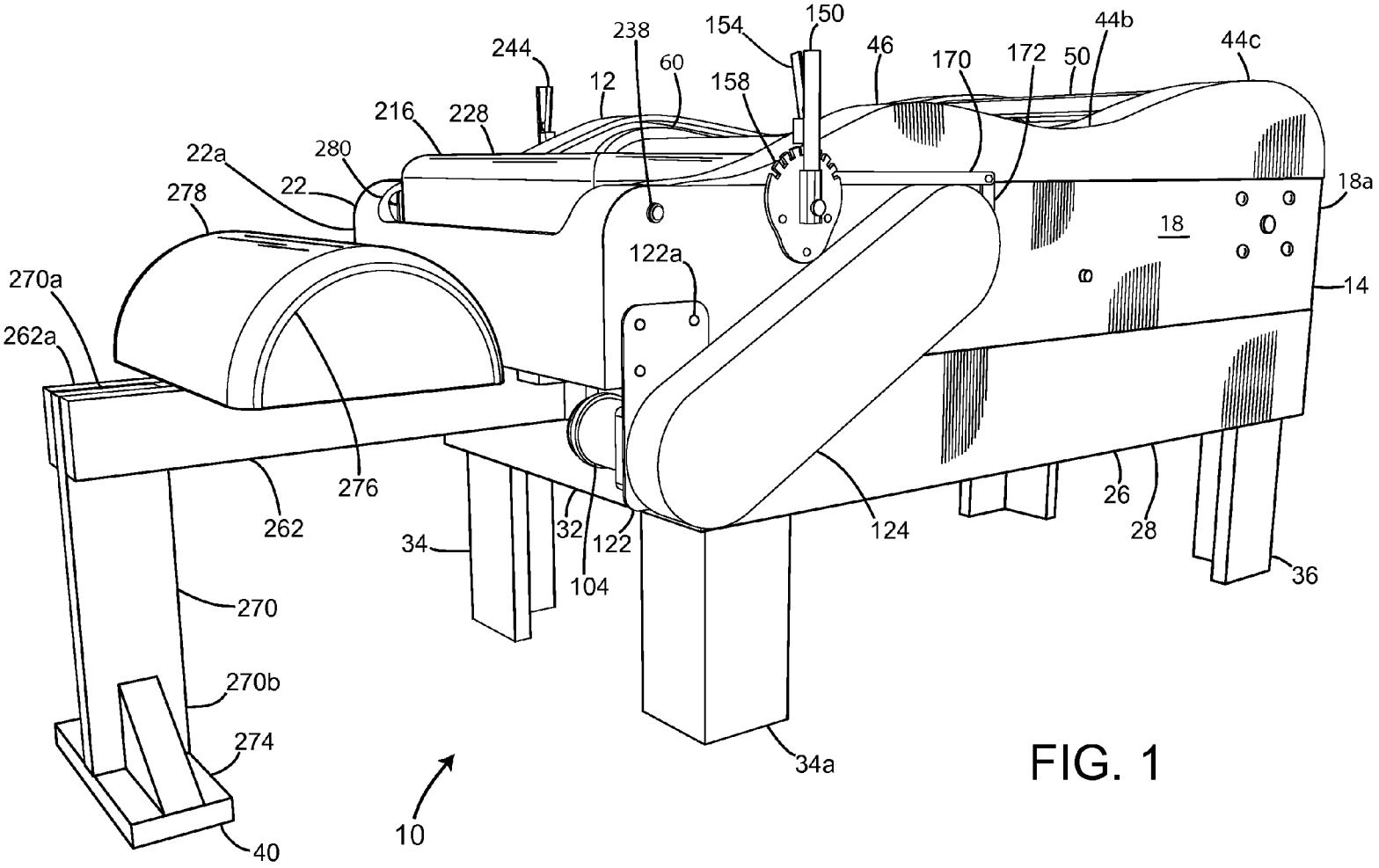
FIG. 1 is a left side perspective view of the preferred embodiment of the present invention illustrating an upper structure mounted atop a frame being supported on a structural base and a leg rest connected to a frontward end member of the structural base.

Referring now to FIG. 1, there is shown generally at 10 a therapeutic apparatus having an upper structure 12 situated and mounted atop a frame 14 for accommodating an individual user for therapeutic care and treatment. The frame is preferentially shown in FIGS. 1-4 as having rightward and leftward sides 16, 18 each having ends 16*a*, 18*a* fixedly attached to ends 20*a*, 22*a* of rearward and forward sides 20, 22 to substantially form a rectangular-boxed structure for housing and mounting interiorly therewithin an inner working assembly 24. In supporting the frame generally above ground level, particularly to facilitate ease by which the individual user may gain access for positioning atop the upper structure 12 to receive therapeutic care, the therapeutic apparatus 10 incorporates within in its overall configuration a structural base 26. Preferably, the structural base is equally configured as a rectangular-boxed structure to the likes of the frame 14 and includes a pair of lengthened side members 28 connected to backward and frontward end members 30, 32 to form the desired shape and four legs 34 extending downwardly from and mounted interiorly within each of the base's four corners. To facilitate ease by which the therapeutic apparatus may be transported from time to time, a bottom rearward portion 36 of each of the two legs situated below and within vicinity of the backward end member 30 may be appropriately equipped with a wheel and frame assembly 38, whereby the act of lifting on the forward side of the frame 14 or a leg rest 40 effects engagement of the wheels with the ground that subsequently provides for rollable movement of the therapeutic apparatus 10 to a desirable location. Optionally, bottom ends 34*a* of all four legs 34 may comprise adjustable leveling pads 42 to accommodate variation in the ground contours to ensure that the therapeutic apparatus resides in a level relationship with the ground for adequate stabilization during operation. As particularly shown in FIG. 2, the lengthened side and backward end members 28, 30 are generally positioned below the rightward and leftward sides and rearward side of the frame, respectively, to correspond evenly therewith insofar to fully carry and support the combined load of the frame 14 with the inner working assembly 24, upper structure 12, and the individual user, while the forward side 22 of the frame is generally cantilevered over or forwardly situated beyond the frontward end member 32 of the structural base to provide space for and accommodate mounting of the leg rest 40.

Figure 5:
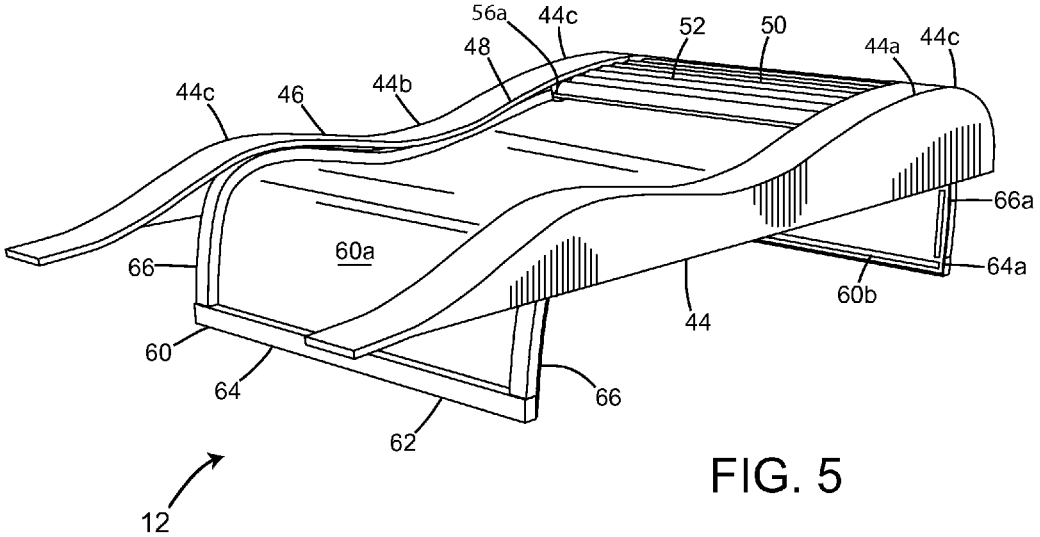
FIG. 5 is a left side perspective view of the preferred embodiment of the present invention illustrating an upper structure having an inner protective shell and a moveable headrest.
Figure 6:
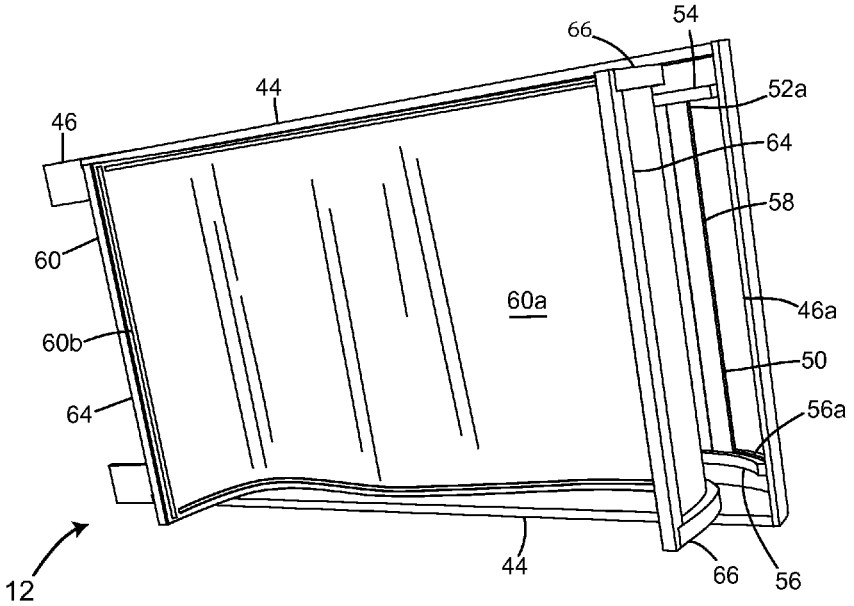
FIG. 6 is a bottom perspective view of the preferred embodiment of the present invention illustrating an upper structure having an inner protective shell.

In reference to FIGS. 5 and 6, the upper structure 12 is generally shown to comprise a pair of sidewalls 44 each having an upper leading edge 44*a* substantially pronounced with a depressed portion 44*b* situated in between a pair arcuate-shaped segments 44*c* that establishes an overall sideward profile sufficiently coinciding with the preferred operable and structural arrangement of the inner working assembly 24, the purpose and functionally of which will be discussed hereinafter in greater detail. A top 46 fixedly attached to upper leading edges 44*a* of the sidewalls permits the sidewalls to exist apart in a parallel relation, wherein the top further includes an open portion 48 designated for receiving an individual user for therapeutic treatment. In furthering comfort to the individual user, the upper structure 12, as preferably shown in FIG. 5, incorporates a moveable headrest 50 particularly configured with a plurality of pads 52 each of elongate form and having ends 52*a* appropriately fitted within slots 54*a*, 56*a* of leftward and rightward tracks 54, 56 that are selectively mounted to an underside surface 46*a* of the top, adjacent to the open portion 48. Each pad 52 in general comprises an elongate board fitted atop thereof with foam or equivalent and sufficiently covered with durable protective sheeting, such as fabric, leather, vinyl, or rubber. A flexible hinge 58, preferentially in the form of fabric or an equivalent type of material attached lengthwise about the elongate board, suffices as means for connecting the pads 52 together. The flexible hinge in this direct application allows each of the pads to minimally rotate relative to one another so that they may slidably move within and freely follow the general arced configuration of the slots 54*a*, 56*a*, particularly as the moveable headrest is optimally positioned to receive and accommodate the individual user's head or upper extremities. Generally affixed to and supplementing the upper structure is an inner protective shell 60, which accordingly serves as a protective interface between the individual user and the operable components of the inner working assembly 24 while aiding in the comfort to the individual user undergoing therapeutic treatment. The inner protective shell, as typically illustrated in FIGS. 5 and 6, comprises a structural frame 62 having a pair of lower structural members 64 connected to a pair of curved structural members 66 that approximate in form to the overall sideward profile generally observed for the sidewalls 44 of the upper structure 12. Pliable material 60*a*, such as foamed neoprene, vinyl, or multilayered stretchable fabric, is preferentially shown extending between the curved structural members and appropriately attached to inward sides 64*a*, 66*a* of the curved and lower structural members by means of a tack strip 60*b*, staples or an equivalent form of fastener suited to pass through the pliable sheeting and penetrate the substrate of the lower and curved structural members 64, 66.

Figure 7:
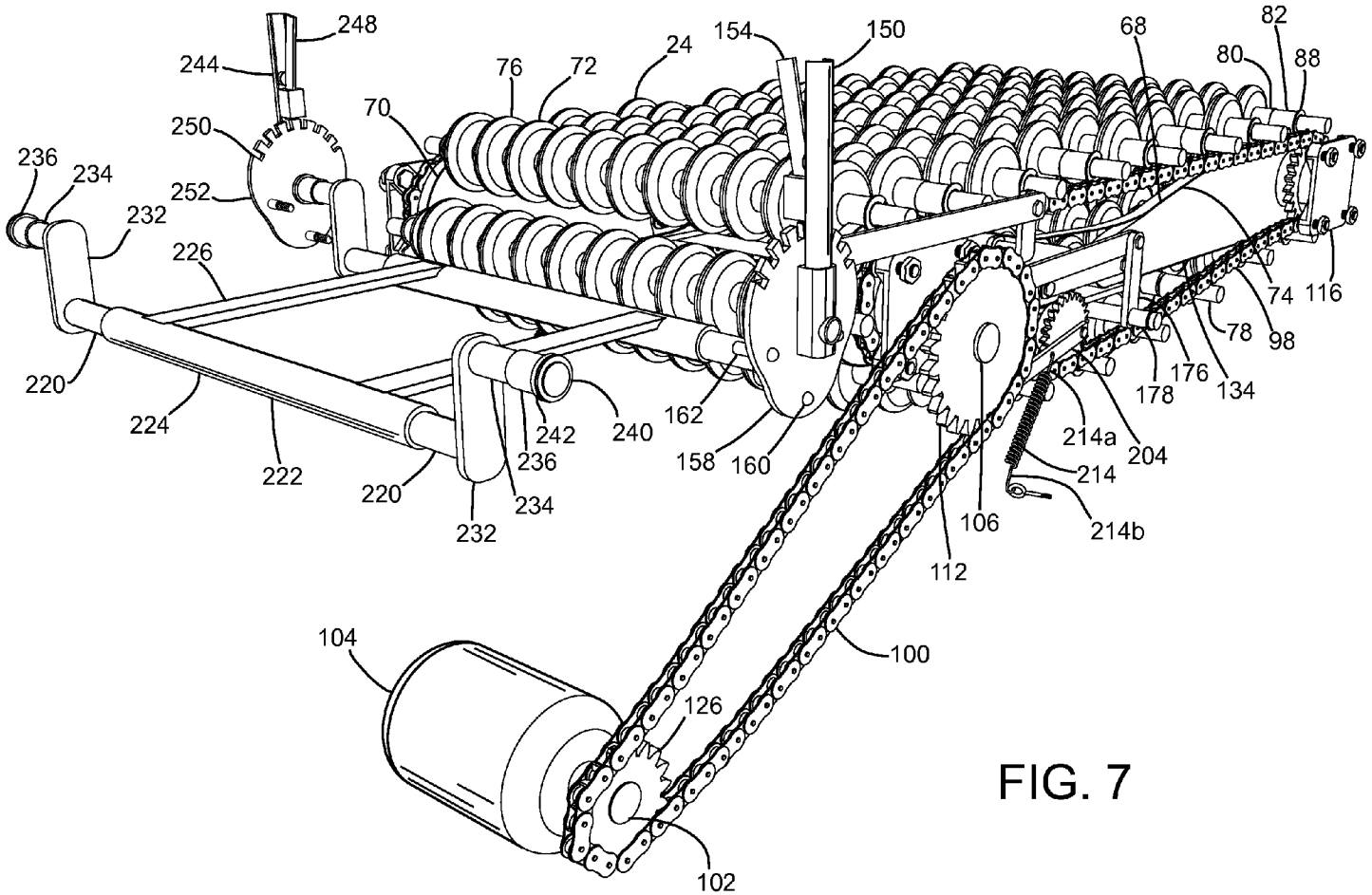
FIG. 7 is a left perspective view of the preferred embodiment of the present invention illustrating an adjustable lower support situated in front of an inner working assembly having a plurality of roller assemblies each connected to an internal drive chain.
Figure 8:
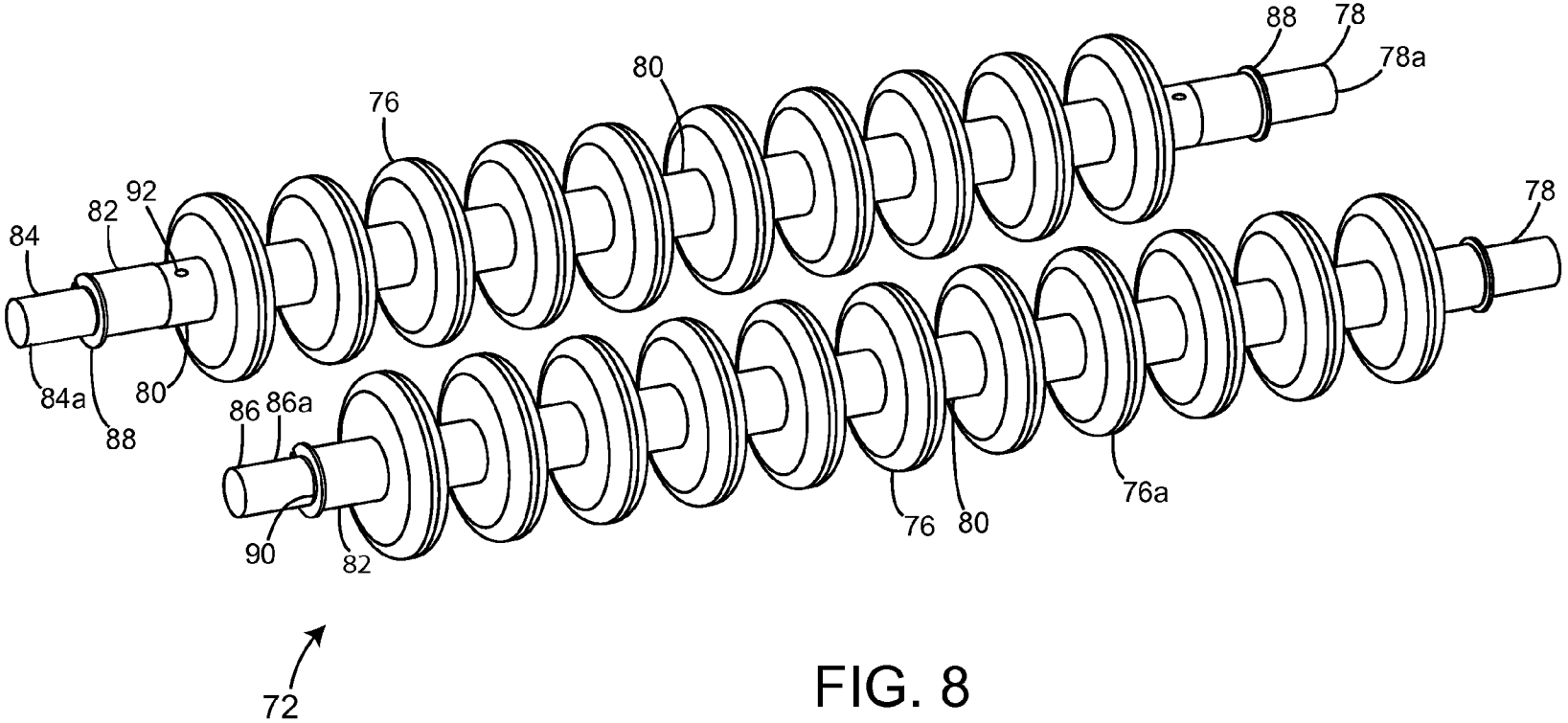
FIG. 8 is a front perspective view of the preferred embodiment of the present invention illustrating first and second rollers shafts each respectively having odd and even number of individual rollers separated by spacers.

The inner working assembly, as generally depicted in FIG. 7, comprises leftward and rightward segments 68, 70 and a plurality of roller assemblies 72 suited to engage with and travel relatively over a flexible guide rail 74 attached to each of the segments. Each roller assembly is shown in FIG. 8 as comprising a plurality of individual rollers 76 mounted to a roller shaft 78 and spaced equally apart from one another by a spacer 80. Ends 78*a* of the roller shaft are slidably fitted with a sleeve bearing 82 particularly suited to ride on and travel relatively over the flexible guide rail 74. In fulfilling the present invention's objective in providing a penetrable massage that effects traction of the spine generally in the area of thoracic and lumber vertebrae and sacrum, each individual roller preferably comprises a circumferential periphery having a general rounded profile with an outward flat portion 76*a* and a diameter generally ranging from 1.75-4 inches and a width generally ranging from 0.5-1.5 inches. In further respects of fulfilling this preferred objective, the individual rollers 76 incorporated within the roller assembly are dimensionally separated from the neighboring individual rollers of an adjacent roller assembly by at least 1.125 inches but by no more than 3.625 inches in order to effect an optimum amount of massaging effect and traction being applied to the spine. Additionally, the individual rollers are preferably spaced apart from the other along the roller shaft 78 by a spacer 80 having a length generally ranging from 0.75-2 inches.

Figure 9:
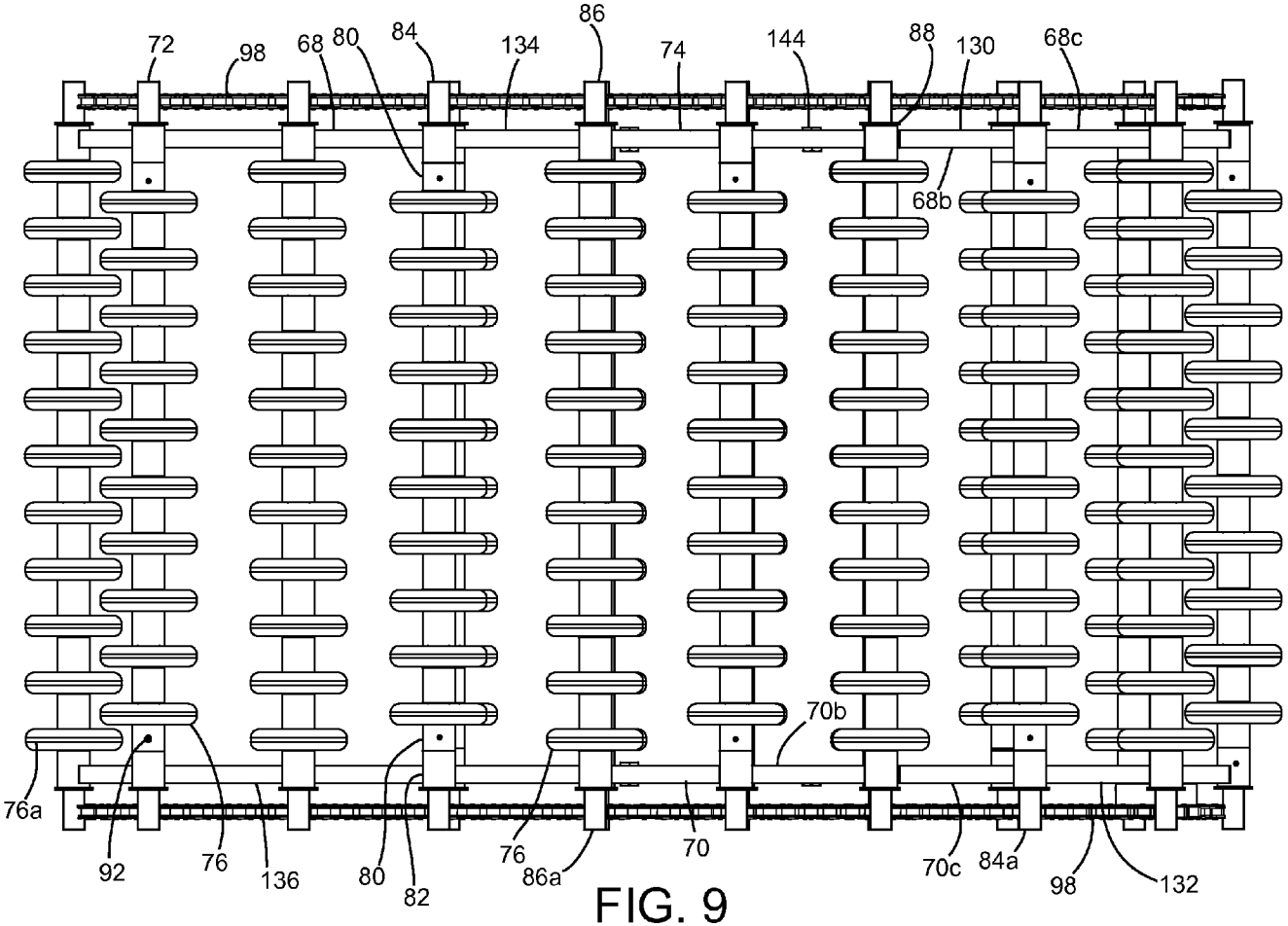
FIG. 9 is a top plan view of the preferred embodiment of the present invention illustrating an inner working assembly having leftward and rightward segments and a plurality of roller assemblies each having a roller shaft with ends connecting to a pair of internal drive chains.

As further apparent in FIGS. 8 and 9, the therapeutic apparatus 10 contemplates use of roller assemblies 72 with even and odd number of individual rollers respectively mounted on first and second roller shafts 84, 86 to fulfill a staggered arrangement or an offsetting relationship among the individual rollers 76. Accordingly, the staggered arrangement of the individual rollers coupled with their preferred dimensional spacing fulfills and establishes an adequate amount of support to the individual user while at rest atop the upper structure 12 while providing an even application of therapeutic pressure relatively around and about the spinal column during therapeutic treatment. Although each roller assembly 72 may comprise any number of individual rollers 76, generally being dictated by the size or dimensional width of the therapeutic apparatus 10, the preferred embodiment thereof, as illustrated in FIG. 8, utilizes a range of at least 10-11 individual rollers per roller assembly such that an individual user of average size comfortably receives therapeutic treatment about the entirety of his/her backside. In completing fabrication of the roller assembly with an odd number of individual rollers, ends 86*a* of the second roller shaft 86 are fitted with sleeve bearings 82, each being particularly placed outside and alongside the two outermost individual rollers. However, in the case of a roller assembly with an even number of rollers, the first roller shaft 84 is supplemented with the spacer 80 being placed in between the outermost individual roller and the sleeve bearing 82 to further establish the offsetting arrangement of the individual rollers when the odd and even numbered roller assemblies are alternately configured to operably associate with roller propulsion means. As further shown in FIGS. 8 and 9, the sleeve bearing 82 as well as the individual rollers 76 separated by spacers 80 are preferably held in an arrangeable manner along the roller shaft by means of a snap ring 88 fitted within an annular groove 90 generally present at the ends of the roller shaft, and in the case of a roller assembly with an even number of individual rollers, set pins 92 are used to secure the outermost positioned spacers to the roller shaft to prevent adverse interaction thereof with the sleeve bearing's capability to freely rotate relatively over the flexible guide rail 74.

Figure 10:
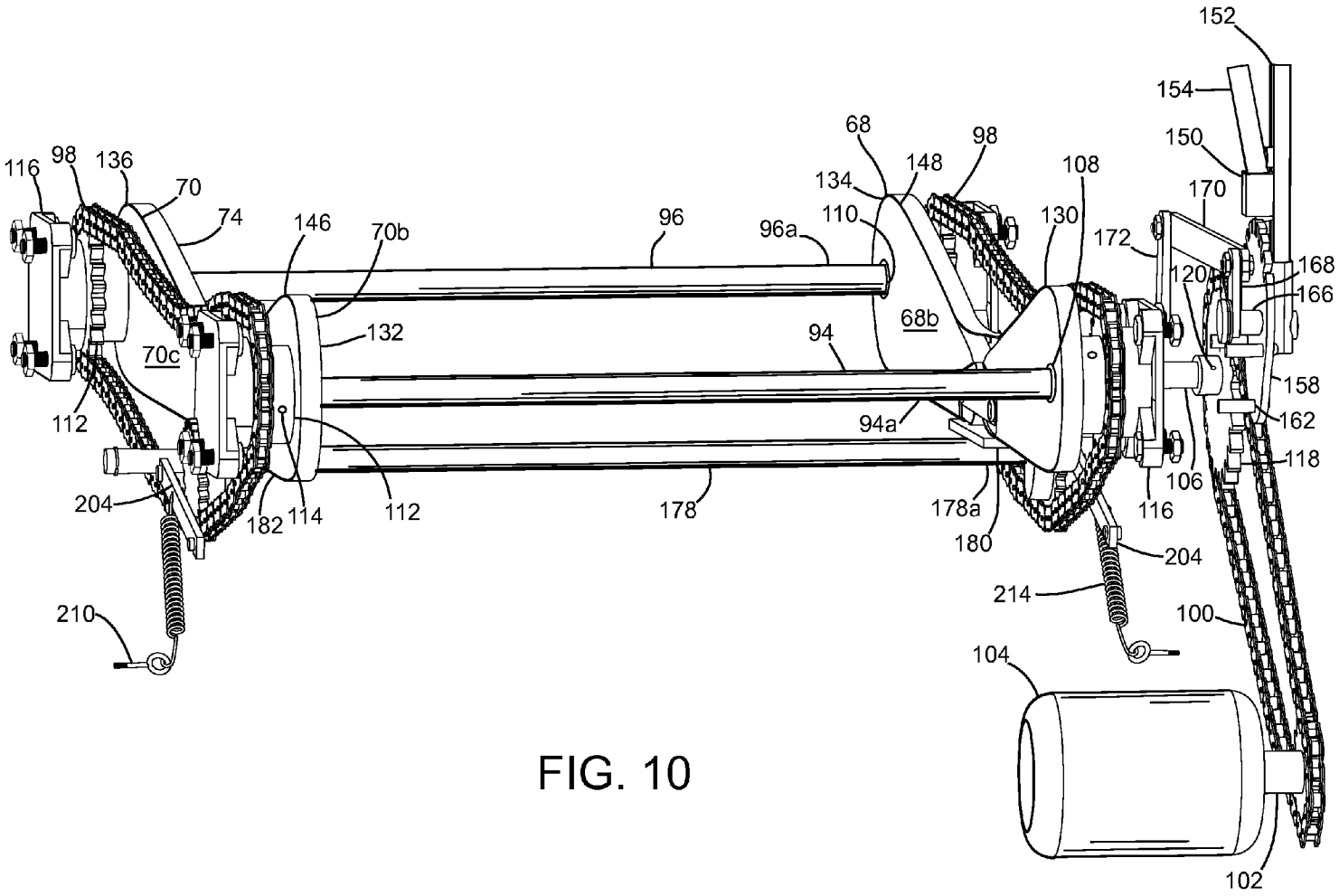
FIG. 10 is a front perspective view of the preferred embodiment of the present invention illustrating an inner working assembly having driving and driven shafts perpendicularly situated in between leftward and rightward segments and connected to a pair of internal drive chains.
Figure 11:
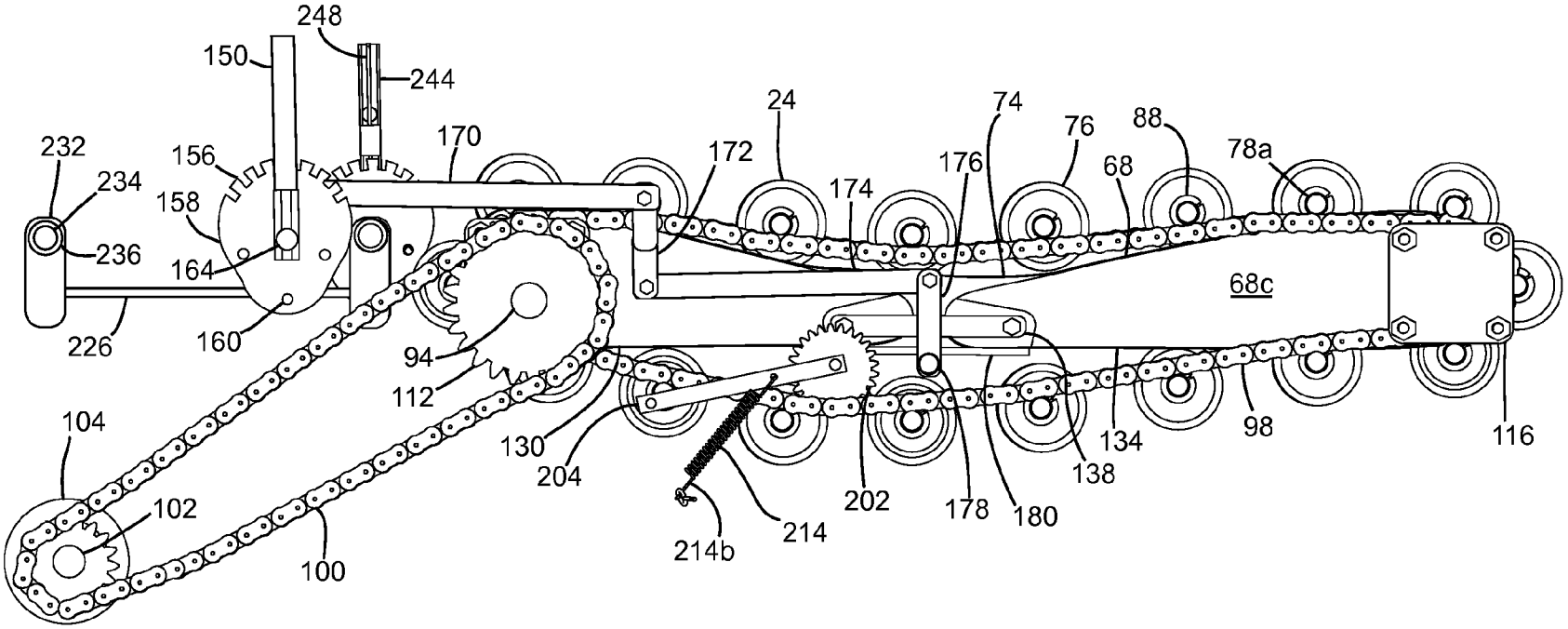
FIG. 11 is a left elevational view of the preferred embodiment of the present invention illustrating a motor having an output shaft fitted with a motor sprocket connecting to a drive sprocket by an external drive chain, a leftward segment having fore and aft lobes, and an adjustable lower support situated in front of an inner working assembly having a plurality of roller assemblies each having a roller shaft connected to an internal drive chain.
Figure 12:
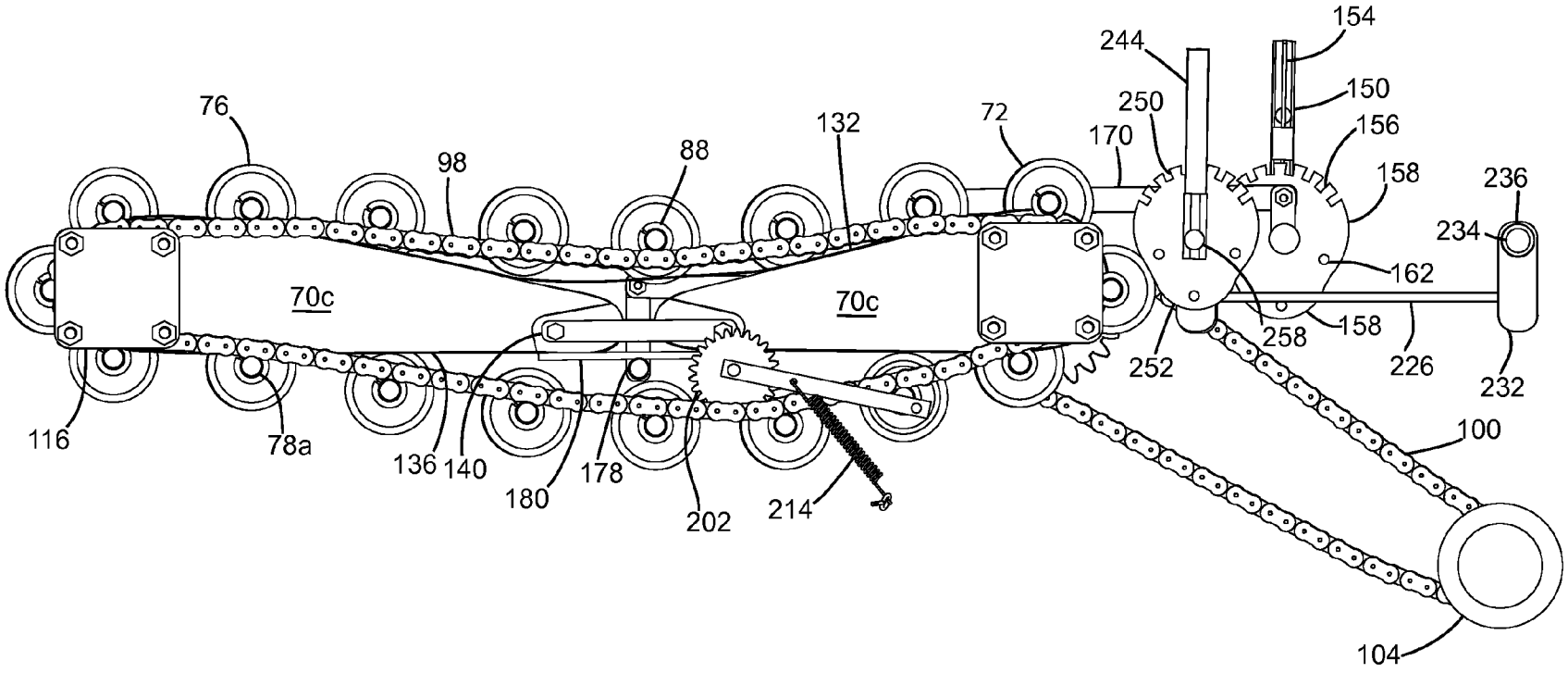
FIG. 12 is a right elevational view of the preferred embodiment of the present invention illustrating a rightward segment having fore and aft lobes and an adjustable lower support situated in front of an inner working assembly having a plurality of roller assemblies each having a roller shaft connected to an internal drive chain.
Figure 13:
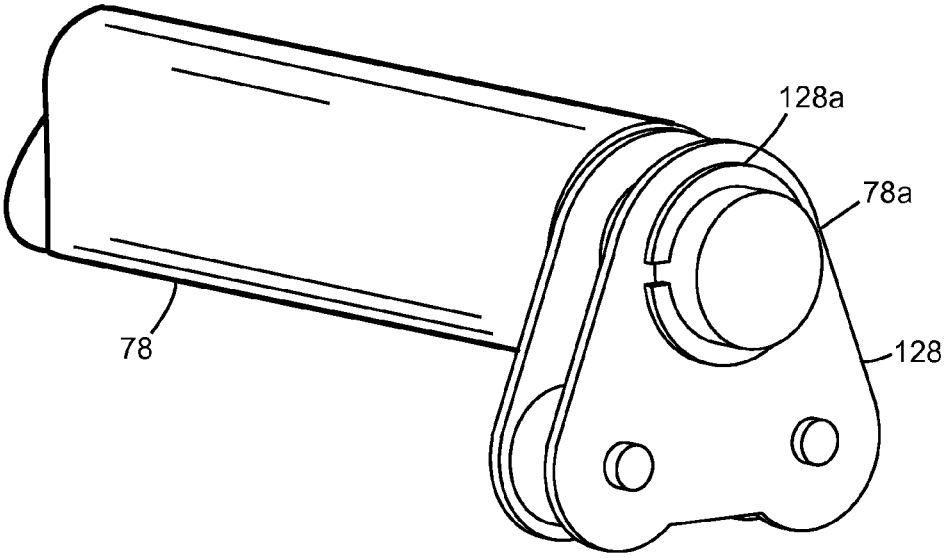
FIG. 13 is a front perspective view of the preferred embodiment of the present invention illustrating a shaft adapter link equipped with a snap ring for securing an end of a roller shaft.

Referring now to FIG. 7, the roller assemblies, as generally associated with the inner working assembly 24, are sufficiently propelled in unison relatively around and over the flexible guide rails 74 of the leftward and rightward segments 68, 70 by roller propulsion means. In the preferred embodiment, roller propulsion means is substantially shown in FIG. 10 as comprising a driving shaft 94 operably linked to a driven shaft 96 by a pair of internal drive chains 98 that collectively operates in conjunction with an external drive chain 100 connecting an output shaft 102 of a motor 104 to a drive end 106 of the driving shaft. The driving and driven shafts generally extend perpendicular in between and pass into the rightward and leftward sides 16, 18 of the frame 14 for mountable support while penetrably passing through the leftward and rightward segments 68, 70. To facilitate smooth rotational action of the driving and driven shafts and minimize premature wear while extending through the segments, each segment is equipped with a sleeve bearing 108 pressed fitted within a shaft aperture 110 generally extending through the segment. As further illustrated in FIG. 10, each end of the driving and driven shafts 94, 96 is fitted with a hub and sprocket assembly 112 that is particularly suited to engage with the individual links of the internal drive chain 98 and drive accordingly the roller assemblies 72 in unison over the flexible guide rails 74. Each hub and sprocket assembly is generally shown in FIG. 10 as being attached to the shaft by means of a setscrew or pin 114 simultaneously held in the hub and shaft. A four-bolt flange bearing 116, generally situated outside the hub and sprocket assembly and mounted interiorly to the side of the frame 14, accepts each sectional end 94*a*, 96*a* of the driving and driven shafts, with exception of the drive end of the driving shaft that is particularly configured to pass through and extend beyond the four-bolt flange to accept an outer sprocket 118 for engagement with the external drive chain 100 used to rotatably drive the driving shaft 94. Like the hub and sprocket assembly, a hub portion of the outer sprocket is affixed to the drive end by a setscrew or pin 120 or possibly welded thereto. Although the motor may be exteriorly or interiorly mounted to the therapeutic apparatus, the motor 104 is preferentially mounted exteriorly thereof by means of a mount plate 122 attached to the leftward side of the frame by screws 122*a* to permit the motor to reside relatively near the frontward end member 32 of the structural base to further its accessibility for repair and maintenance, as substantially shown in FIG. 1. A cover 124 may be mounted to the leftward side of the frame to protect or guard against the individual user's inadvertent interaction with the external drive chain 100 during operation. A motor sprocket 126 mounted to the output shaft 102 of the motor 104 is appropriately configured to minimally project outward from the leftward side 18 so as to align with and accept a portion of the external drive chain 100 and is generally shown in FIG. 1 as being housed within the cover along with the outer sprocket 118 connected to the drive end 106 of the driving shaft. Although the roller assemblies of the therapeutic apparatus can conceivably operate within a moderate range of speeds, it is generally preferred that the present invention utilizes a variable speed motor 104 operating at 13 rpm to fulfill an operational rate of 12 feet/minute for the roller assemblies 72, generally as such to satisfy most individual users' expectation of comfort while undergoing therapeutic treatment. It is generally contemplated within the scope of the present invention that the roller shafts 78, 84, 86 of the roller assemblies may be attached to the internal drive chain 98 by a variety of means, including, but not limited to, placement of a bead of weld at the point contact between the shaft end and a link of the internal drive chain, as preferably used and shown in FIGS. 11 and 12, replacement of one of the chain links with a shaft adapter link 128 equipped with a snap ring or pin 128*a* of the type illustrated in FIG. 13 to affix the shaft end 78*a* to the shaft adapter link, or any other attachment means generally available and known in the art that is well suited to affix the shaft's end to the internal drive chain 98.

Figure 14:
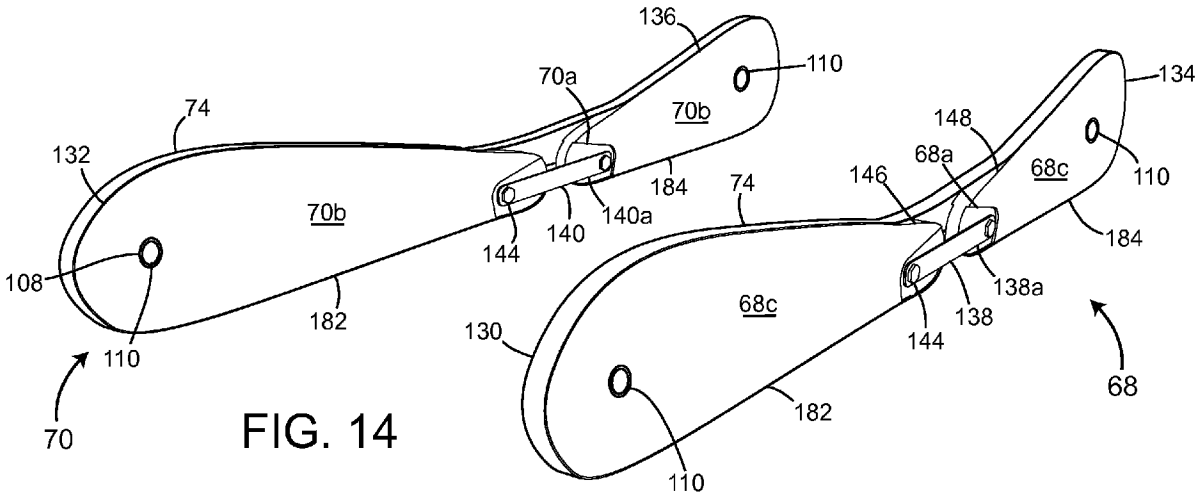
FIG. 14 is a left perspective view of the preferred embodiment of the present invention illustrating leftward and rightward segments each having fore and aft lobes connected by a hinge mechanism and a flexible guide rail.

In furthering the manner in which the therapeutic apparatus 10 achieves its capacity to geometrically conform to one's backside, thus administer a level of uniform therapeutic pressure about the spinal column, the leftward and rightward segments 68, 70 each comprise fore and aft lobes 130, 132, 134, 136 of distinct curvature shape that are configured for independent movement relative to one another, as generally depicted in FIG. 14. In facilitating this preferred independent action, the fore and aft lobes for each of the leftward and rightward segments are connected together by a hinge mechanism 138, 140 of the type illustrated in FIG. 14 and operate conjunctively with a lever linkage assembly 142 within reach and under the control of the individual user. The hinge mechanism connecting the fore and aft lobes together predominately comprises a pair of planar elements 138*a*, 140*a* placed within recessed portions 68*a*, 70*a* generally present on inward and outward sides 68*b*, 70*b*, 68*c*, 70*c* of the leftward and rightward segments to primarily establish an opposing relation of the planar elements and prevent deleterious interaction with the internal drive chain 98 and roller assemblies during operation. Each end of the planer element is specifically shown in FIG. 14A as comprising an aperture 138*b*, 140*b* selectively in alignment with an aperture 68*d*, 70*d* extending through the recessed portion so as to accommodate therewithin a fastener, preferably in the form of a bolt and nut assembly 144. By means of this arrangement, the hinge mechanism inherently allows independent pivotal movement of the fore and aft lobes generally about each of the bolt locations, but the degree of movement of the lobes is generally limited by the presence and structural arrangement of the flexible guide rail 74.

In reference to FIG. 14, the flexible guide rail is preferentially configured as an elongate planar strap screw mounted to perimeter portions of the fore and aft lobes and comprises first and second ends 74*a*, 74*b* generally shown attached in vicinity of the recessed portions of the fore and aft lobes, respectively. Because of the structural continuity of the flexible guide rail from its first end to its second end, the flexible guide rail generally forms a structural bridge extending across upper perimeter portions 146, 148 of the fore and aft lobes that preferentially serves to guide and support the roller assemblies as they travel around the segments, while supplementally serving as means for connecting together the lobes with that of the hinge mechanism 138, 140 and limiting their degree of pivotal movement relatively about the fasteners or bolts associated with the hinge mechanism. However, the capability of the fore and aft lobes to pivotally move or angularly travel relative to one another is made possible by the partial unattached state of the flexible guide rail 74 along upper perimeter portions of the lobes and lack of structural continuity of the flexible guide rail at the location where the first and second ends 74*a*, 74*b* attach to the lobes near and below the hinge mechanism, as generally depicted in FIG. 14B.

Figure 14A:
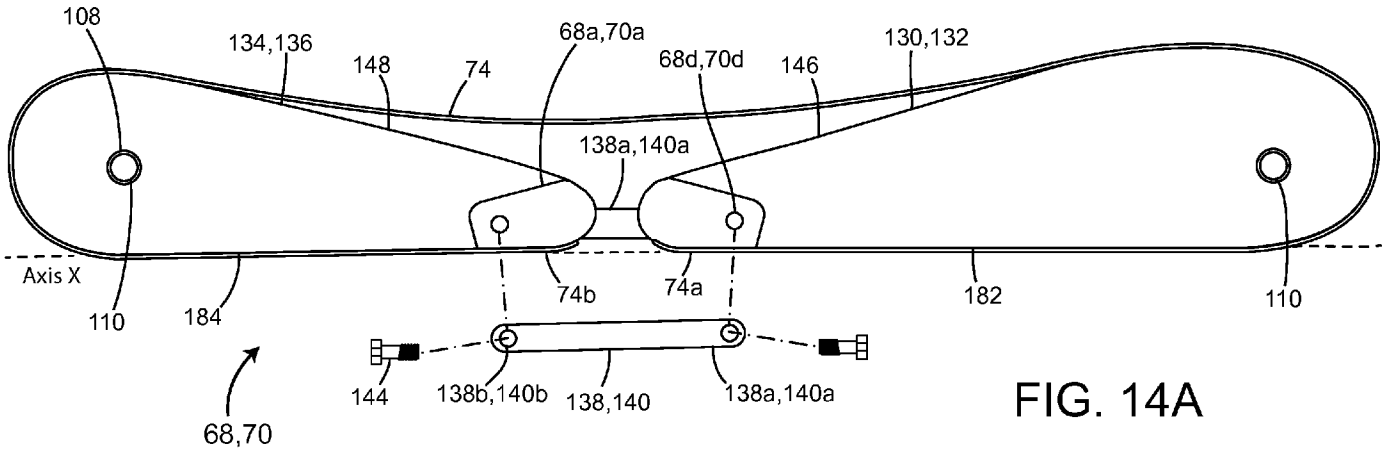
FIG. 14A is a side elevational view of the preferred embodiment of the present invention illustrating fore and aft lobes of either a leftward or rightward segment in a neutral position along axis X.
Figure 14B:
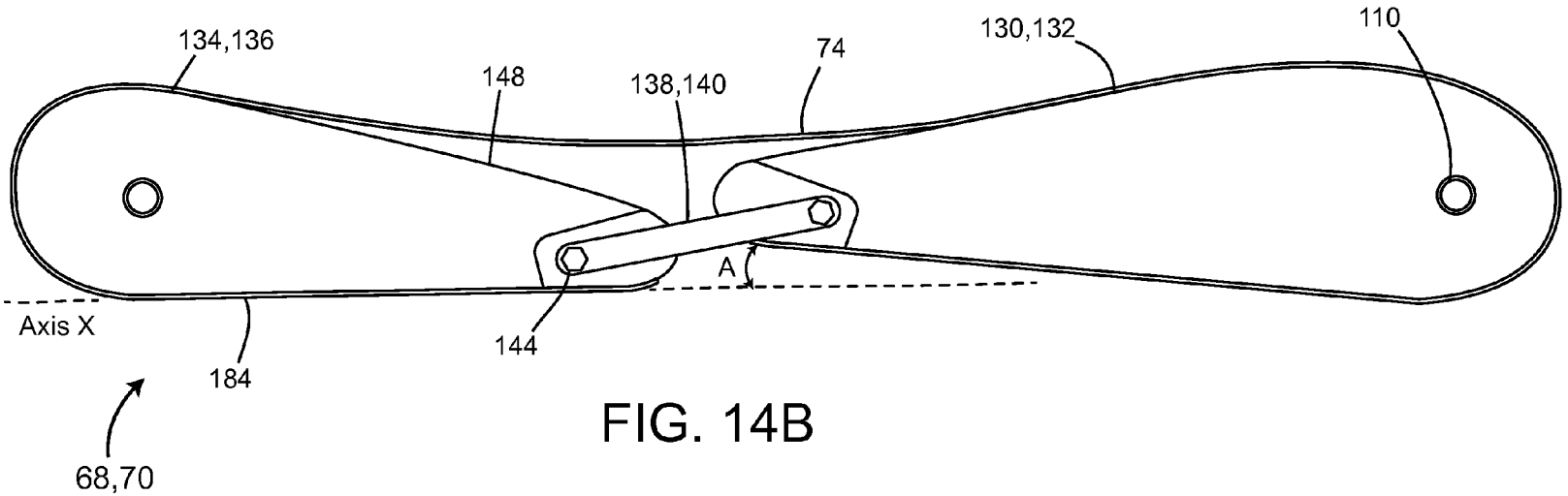
FIG. 14B is a side elevational view of the preferred embodiment of the present invention illustrating fore and aft lobes of either a leftward or rightward segment wherein the fore lobe is angularly positioned above axis X.
Figure 14C:
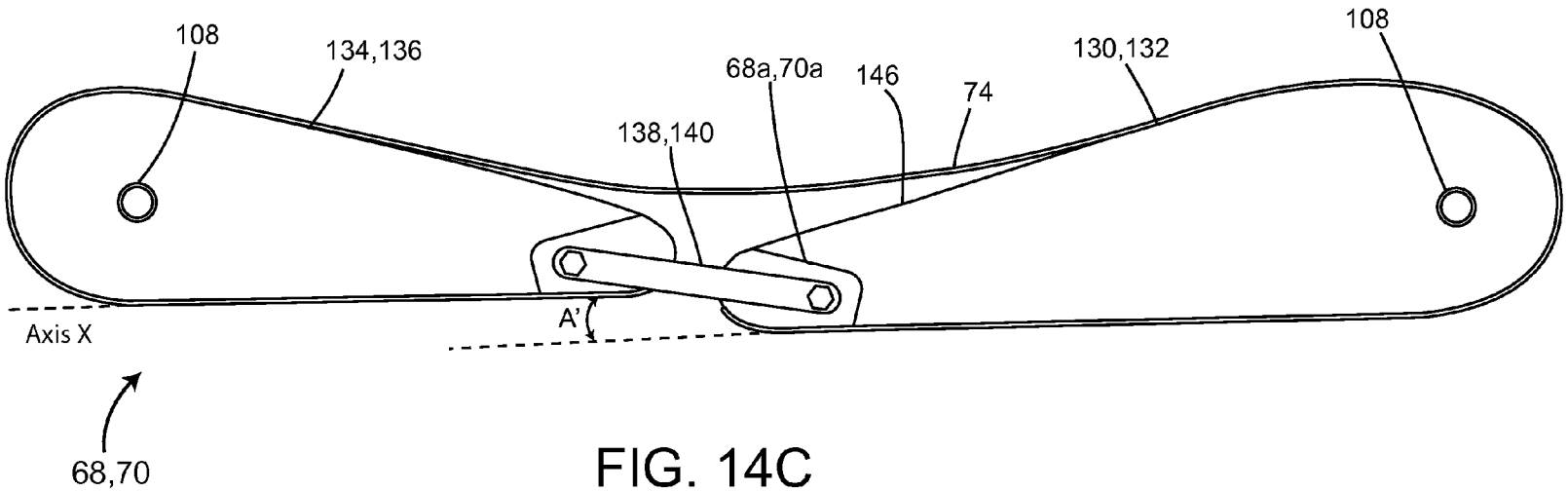
FIG. 14C is a side elevational view of the preferred embodiment of the present invention illustrating fore and aft lobes of either a leftward or rightward segment wherein the fore lobe is angularly positioned below axis X.

The extent by which the flexible guide rail is left unattached to the fore and aft lobes of either the rightward and leftward segments is generally governed by the preferred range of motion of the lobes relative to their bottom perimeter portions in linear arrangement along axis X, as typically illustrated in FIG. 14A. Preferentially, the bottom perimeter portion of each lobe possesses the innate capacity to be angularly orientated above or below axis X, generally to extend as much as 10° above axis X along path A as represented in FIG. 14B or 10° below axis X along path A' as represented in FIG. 14C for a complete range of motion along path AA' of approximately 20°. Consequently, through this range of motion for each of the lobes, the roller assemblies 72 are allowed to follow the flexible guide rail under a variety of geometric profiles that is most conducive to correspond with the curvature of the spinal column for an administration of a comprehensive therapeutic massage.

Figure 16:
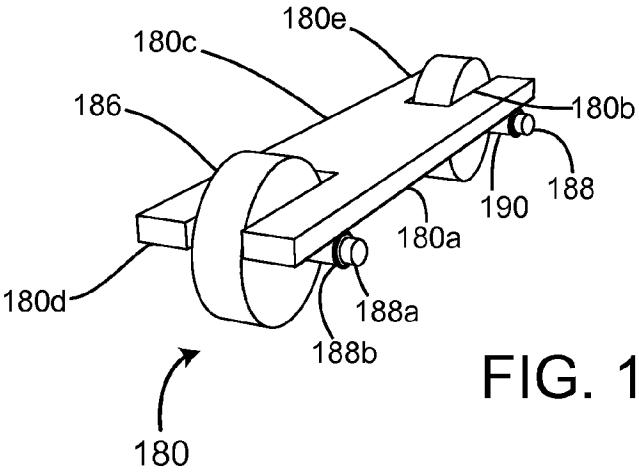
FIG. 16 is a front perspective view of the preferred embodiment of the present invention illustrating a leveraging arm having fore and aft ends each fitted with a slotted section for accepting therewithin a wheel mounted onto a shaft.
Figure 15:
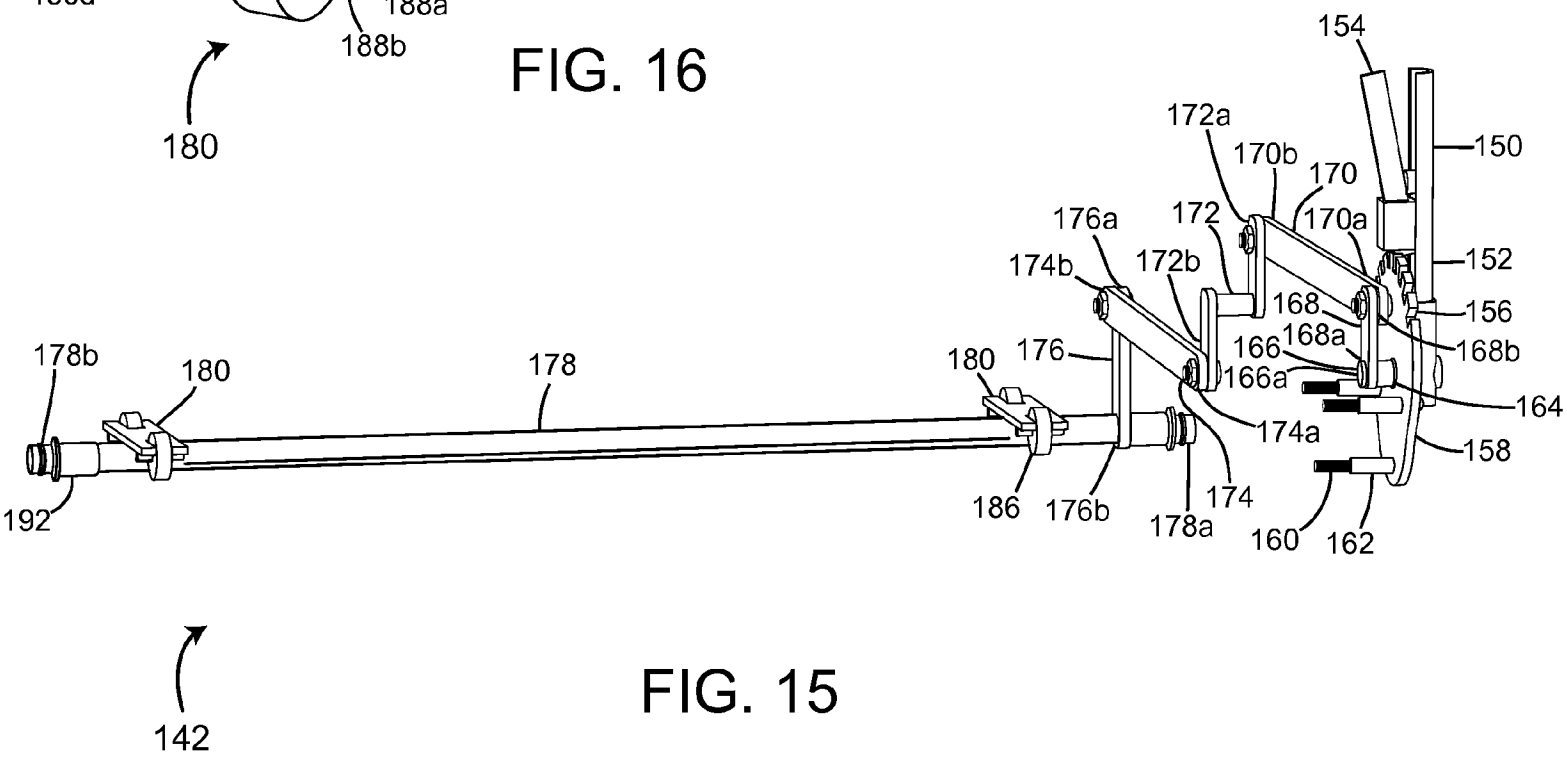
FIG. 15 is a front perspective view of the preferred embodiment of the present invention illustrating a lever linkage assembly having first, second, third, fourth, and offsetting linkage members and a pair of leveraging arms attached to a leveraging rod.

Now in particular reference to FIGS. 7 and 15, the ability or capacity to direct alteration of the position of the fore and aft lobes about the hinge mechanism in the preferred manner discussed above and consequently alter the geometric profile of the flexible guide rails is primarily maintained by the manual manipulation of a lobe lever control 150 associated with the lever linkage assembly 142. The lobe lever control is particularly shown in FIG. 15 as comprising a pivoting handle 152 with a spring-loaded moveable locking latch 154 for engaging one of a series of notches 156 present on a mounting plate 158. The mounting plate is generally suited for attachment to an exterior side of the frame by at least three bolts 160 fitted within spacers 162. The pivoting handle generally includes a cylindrical aperture 164 for accepting therewithin a shaft 166 having an end portion 166*a* connected to a first end 168*a* of a first linkage member 168 that extends upwardly alongside the leftward side of the frame 14. A second linkage member 170 having first and second ends 170*a*, 170*b* is shown respectively connected to a second end 168*b* of the first linkage member and a first end 172*a* of an offsetting linkage member 172. Similarly, a second end 172*b* of the offsetting linkage member 172 is generally shown attached to a first end 174*a* of third linkage member 174. The offsetting linkage member in this regard serves to offset the arrangement of the second linkage member 170 placed exteriorly about the frame 14 from the third linkage member 174 placed interiorly within the frame. As further shown in FIG. 15, a second end 174*b* of the third linkage member is generally connected to a first end 176*a* of a fourth linkage member 176, while an end portion 178*a* of a leveraging rod 178 is connected to a second end of the fourth linkage member. To fully enable the leveraging rod to preferentially move each of the lobes in the manner discussed hereinbefore, the leveraging rod comprises a pair of leveraging arms 180 each preferably of elongate, planar form and fixedly attached in vicinity where the leveraging rod 178 generally passes below the rightward and leftward segments near their respective hinge mechanisms, as generally represented in FIG. 10. Although it is quite acceptable to allow fore and aft ends 180*d*, 180*e* of each leveraging arm to solely act on and leverage the fore and aft lobes to the desired angular position, respectively, it is preferred that the fore and aft ends of the leveraging arm include frictional minimizing means for minimizing the frictional interaction with the bottom perimeter portions 182, 184 of the fore and aft lobes during momentary applications of leveraging action. Accordingly, in this regard, frictional minimizing means preferably comprises a wheel 186 slidably mounted onto a shaft 188 extending through a pair of sleeves 190 fixedly attached to a bottom surface 180*a* of the leveraging arm 180, generally on each side of a slotted section 180*b*, as generally represented in FIG. 16. Snap rings 188*b* placed into ends 188*a* of the shaft serve to retain positioning of the shaft and wheel during operation. Alternatively, a top surface 180*c* of the leveraging arm near the fore and aft ends 180*d*, 180*e* may comprise Teflon tape, a lubricant, or an equivalent form of friction-reducing material to guard against premature wear and ease the frictional interaction between the surfaces of the leveraging arms and bottom perimeter portions of the fore and aft lobes. In maintaining the preferred position of the leveraging rods within vicinity of the rightward and leftward segments, ends of the leveraging rod 178 are shown in FIG. 15 as being slidably placed within sleeve bearings 192 mounted within apertures 194 extending through the rightward and leftward sides of the frame 14. Snap rings 178*b* or cotter pins engaging ends of the leveraging rod serve to prevent lateral movement thereof during manual manipulation of the lobe lever control 150 to effect the desired amount of leveraging action on the fore and aft lobes via the leveraging arms 180. Although the preferred embodiment of the therapeutic apparatus 10 describes first, second, third, fourth, and offsetting linkage members operating conjunctively with the leveraging rod to satisfy and fulfill angular movement of the fore and aft lobes, it is generally understood that the present invention may employ any number of linkage members and/or configurations thereof to accomplish the requisite leveraging action on the fore and aft lobes. Furthermore, it is quite conceivable within the scope of this disclosure that the present invention may employ in lieu of the linkage members a number of actuators (hydraulic, pneumatic, electric or mechanical) of the type generally available in the art to effect mechanical rotational motion of the leveraging rod that furthers the requisite amount of leveraging action on the fore and aft lobes.

Figure 17:
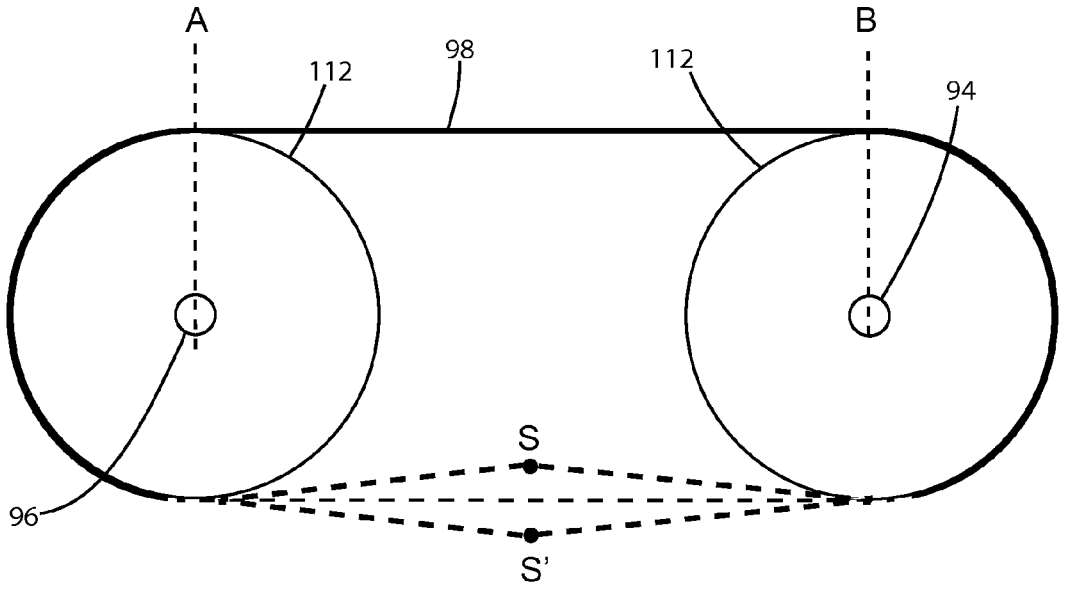
FIG. 17 is a schematic view of the preferred embodiment of the present invention illustrating chain slack SS''required for an internal drive chain connecting a driving shaft to a driven shaft.

Since the therapeutic apparatus inherently provides for alteration of the lobes' positions that consequently alters the geometric profile of the flexible guide rails 74 to generally correspond with the curvature of the spinal column in the manner noted herein, it is inherently required that roller propulsion means includes internal drive chains 98 each having a predetermined amount of chain slack to fulfill operation of the lobes within their entire range of angular motion relative to axis X, in addition to providing an adequate amount of clearance among neighboring operating components. Accordingly, it is preferred that each internal drive chain comprises an amount of chain slack, as schematically represented as length SS' in FIG. 17, based on 5-10 percent of the span or distance A-B held in between the sprockets of the driving and driven shafts 94, 96.

Figure 18:
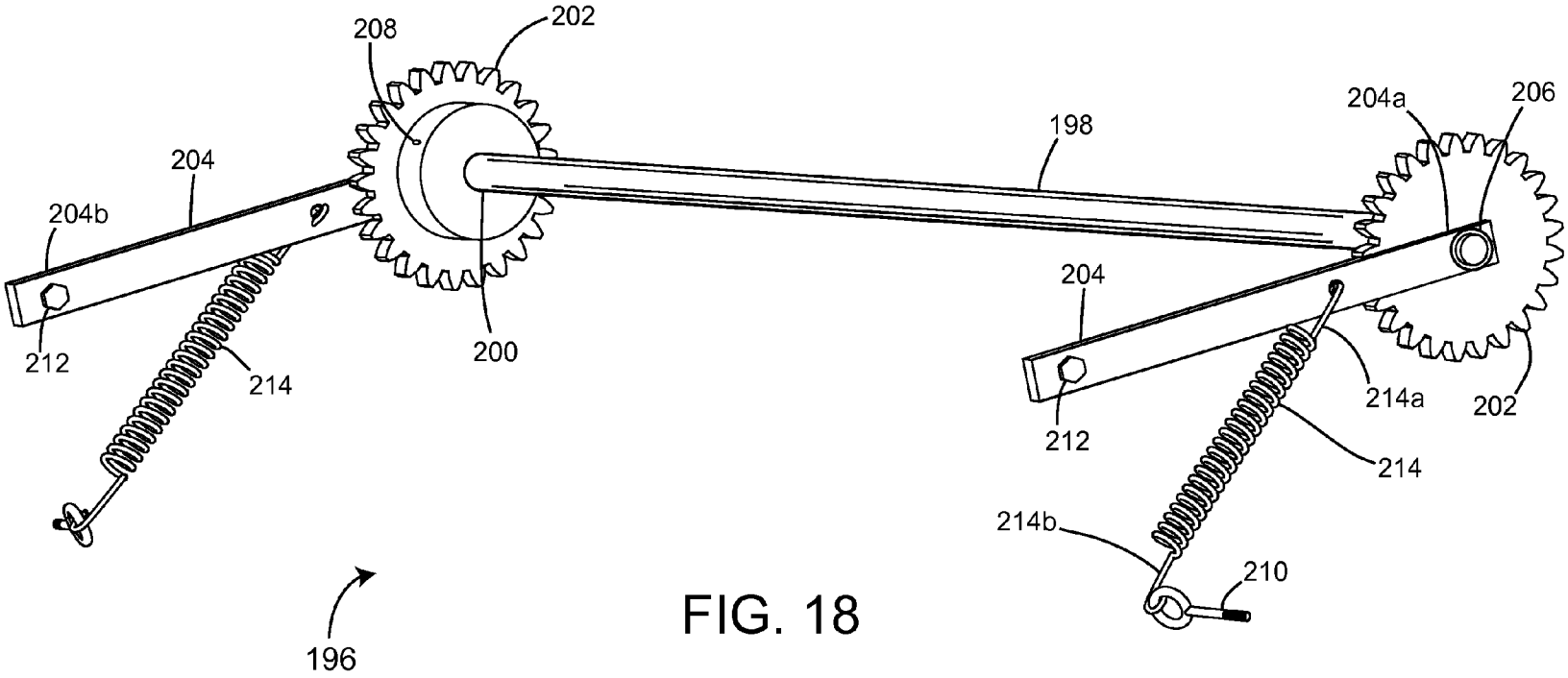
FIG. 18 is a front perspective view of the preferred embodiment of the present invention illustrating a tensioner assembly having a pair of idle sprocket and hub assemblies and a pair of outward support bars mounted to ends of a bar and a pair of springs connected to the outward support bars.

In some instances of operation, the degree of chain slack may appear less or more predominate along either the upper or bottom perimeter portions of the fore and aft lobes when the lobes reach a maximum amount of angular position, for example 10° above or below axis X, particularly as such to possibly interfere with neighboring operating components. However, in a general neutral position where the bottom perimeter portions of the lobes linearly coincide with axis X, the presence of chain slack may appear above and below the rightward and leftward segments. Accordingly, it becomes necessary to incorporate within the operable structure of roller propulsion means a tensioner assembly 196 to take up the resultant excess amount of chain slack produced during certain modes of operation such as to eliminate the internal drive chain's opportunity to interfere with neighboring operating components. The tensioner assembly, as particularly illustrated in FIG. 18, comprises a bar 198 having a pair of outward ends 200 each slidably fitted with an idle sprocket and hub assembly 202 and connected to a first end 204*a* of an outward support bar 204. Snap rings 206 or cotter pins fitted at the bar's end and a setscrew 208 passing into the idle sprocket and hub assembly 202 sufficiently serve to hold and prevent lateral movement of the outward support bar and idle sprocket and hub assembly, respectively, apart from the bar 198 during operation. Second ends 204*b* of the outward support bars are shown in FIG. 18 as being pivotally connected to rightward and leftward sides of the frame by pivoting means, primarily comprising a bolt and nut arrangement 212. Biasing means, preferably in the form of a pair of springs 214 each having ends 214*a*, 214*b* connected in vicinity of the first end 204*a* of the outward support bar and to the lengthened side members 28 of the base by an eye bolt 210, respectively, serves to bias the outward support bars 204 downwardly with that of the bar 198 to retain a degree of tension in the internal drive chains 98 as links of the chains engage around a select number of teeth associated with the idle sprocket and hub assembly 202.

Figure 19:
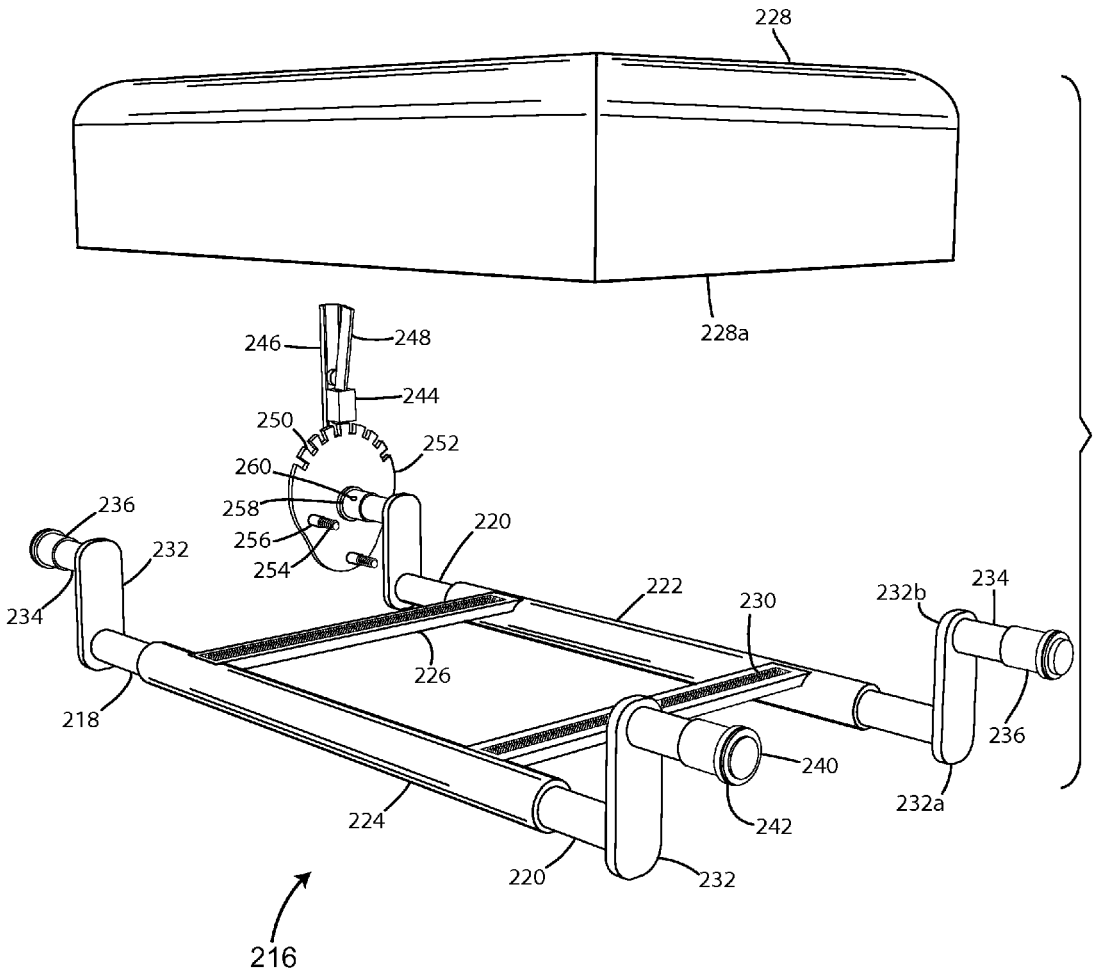
FIG. 19 is a front perspective view of the preferred embodiment of the present invention illustrating an adjustable lower support with a padded seat hovering above a seat assembly slidably mounted onto a platform assembly.

Referring now to FIG. 19, the therapeutic apparatus 10 contemplates within its scope of structural features an adjustable lower support 216 that operates conjunctively with the roller assemblies to effect traction of the spinal column. In particular, the adjustable lower support comprises a platform assembly 218 fabricated from a pair of parallel-positioned support bars 220 suited for attaching thereto a seat assembly 222. The seat assembly is generally shown in FIGS. 7 and 19 as comprising a pair of cylindrical sleeves 224 slidably mounted to the parallel-positioned support bars 220 and connected together by a pair of inner brace members 226 that assist in moving the parallel-positioned support bars in unison as the adjustable lower support 216 is repositioned from time-to-time and accept for mounting atop thereof a padded seat 228. Although the padded seat may be mounted by a variety of methods, it is preferred to mount the padded seat by placement of a hook-and-loop fastener 230 atop the inner brace members 226 and bottom side 228*a* of the padded seat so as to further the possibility or later opportunity to readily remove the padded seat 228 to gain immediate access to operable components generally located in vicinity of and below the adjustable lower support, such as electrical connections generally associated with the motor 104, for example.

Each end of the parallel-positioned support bar is generally shown connected to a first end 232*a* of an upward link 232 while a second end 232*b* of the upward link is shown connected to an outward shaft 234, collectively being arranged to allow the support bar to co-align with the upward link and outward shaft. As generally illustrated in FIG. 19, each outward shaft is appropriately fitted with a sleeve bearing 236 to facilitate ease by which the outward shaft rotates relatively within an aperture 238 generally extending through the leftward and rightward sides of the frame 14. Securing means, preferably in the form of a snap ring 240 fitted within an annular groove 242 present on the outward shaft or cotter pin or setscrew passing into the outward shaft, may be used to secure the adjustable lower support's lateral position within the frame's structure.

Figure 3:
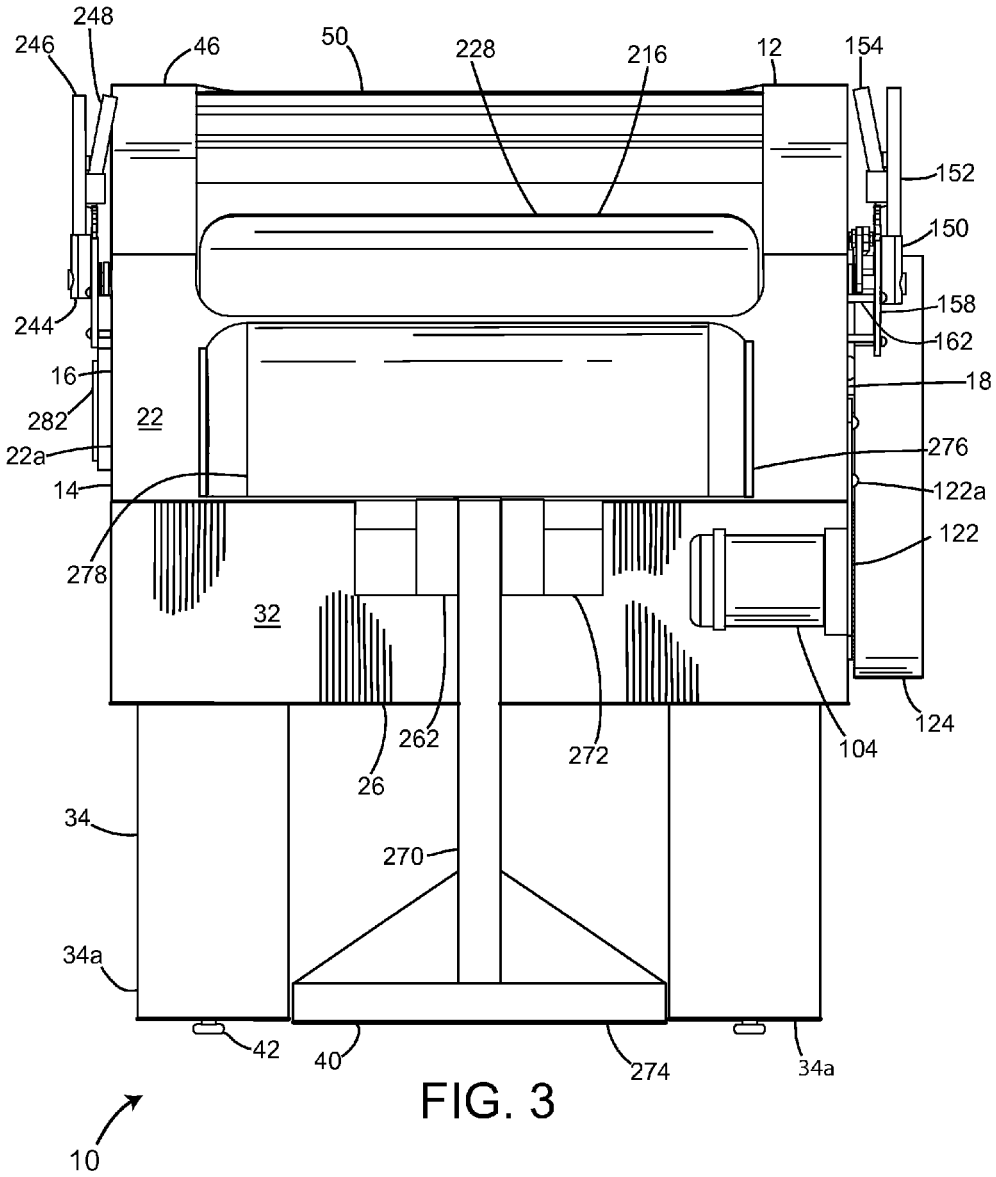
FIG. 3 is a front elevational view of the preferred embodiment of the present invention illustrating lobe and seat lever controls, an adjustable lower support, a leg rest, and an upper structure mounted atop a frame being supported by a structural base.
Figure 4:
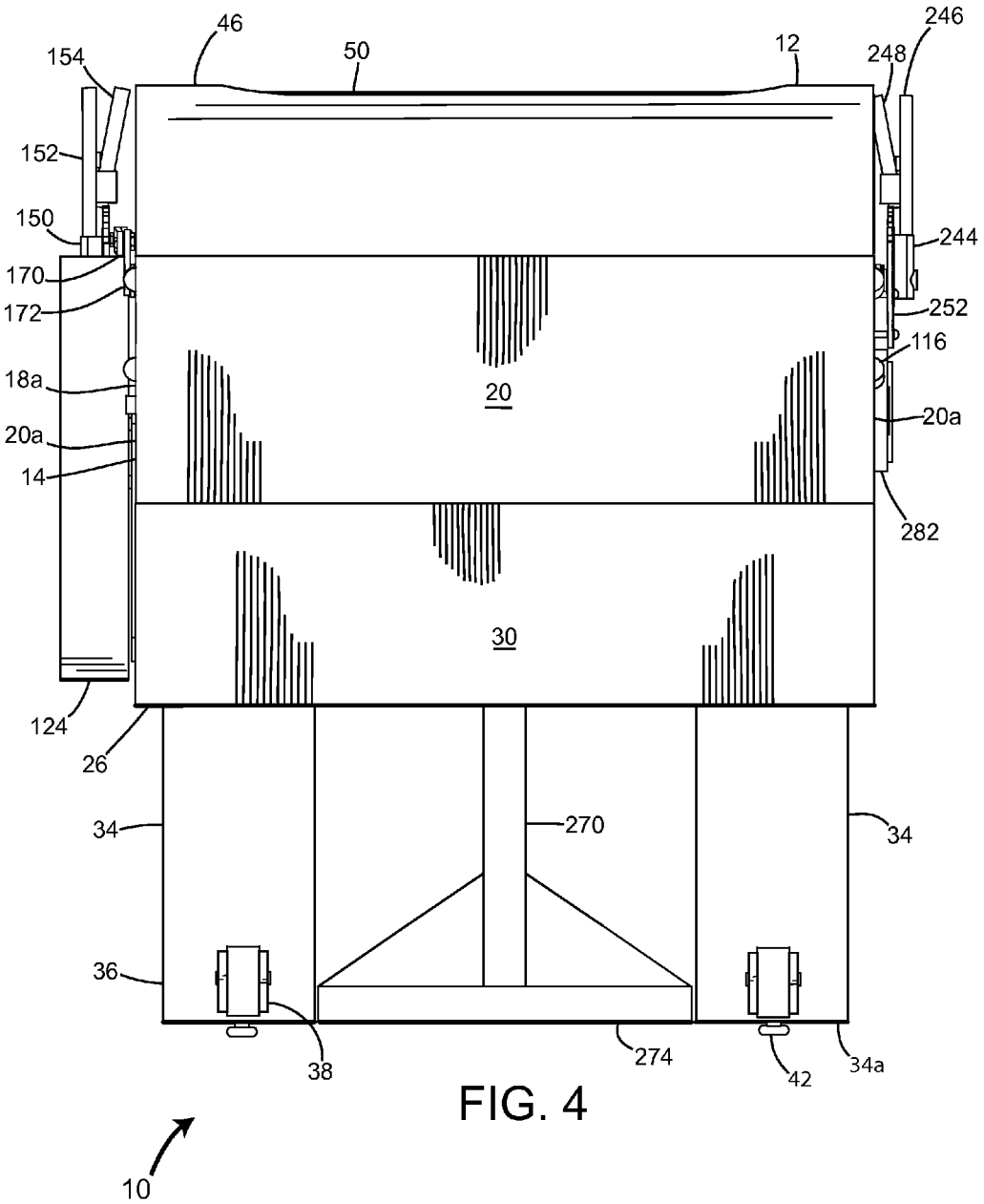
FIG. 4 is a back elevational view of the preferred embodiment of the present invention illustrating an upper structure mounted atop a frame being supported by a structural base equipped with wheel and frame assemblies.

As generally depicted in FIG. 19, the adjustable lower support 216 is supplemented with a seat lever control 244 that suffices to adjust the position of the padded seat relative to the fore lobes and closely resembles the lever control used for manipulating the position of the lobes, notably terms of physical structure and operation. The seat lever control is generally shown in FIG. 3 as being positioned across from the lobe lever control within general reach of the user and comprises a pivoting handle 246 with a spring-loaded moveable locking latch 248 for engaging one of a series of notches 250 present on a mounting plate 252. The mounting plate is generally suited for attachment to an exterior side 14*a* of the frame by at least three bolts 254 fitted within spacers 256. The pivoting handle is shown supplemented with a cylindrical aperture 258 for receiving therewithin a portion of one of the outward shafts that is appropriately lengthened to accommodate operable mounting of the seat lever control. A setscrew or pin 260 passing into the lengthened portion of the outward shaft serves to lock or hold the seat lever control's position relatively to the side of the frame.

In its principal modes of operation that appropriately fulfills the utilitarian objects of the present invention, the padded seat of the adjustable lower support is generally configured in an upward positional setting to accommodate and support the user's buttock to primarily effect muscular massage about the individual user's backside and is generally held in a downward and forward positional setting to primarily effect traction of the spine. By means of adjusting the padded seat 228 to this downward and forward positional setting, the individual user's pelvis is effectively allowed to drop or fall to a slight degree to eventually become fully supported by the roller assemblies, at which time the rotating action of the roller assemblies moving upward or downward relatively over and around the fore lobes of the leftward and rightward segments, depending on the user's directional setting for the roller assemblies 72, are allowed to penetrably act on and move the pelvic region generally in an upward and downward and inward and outward sequential motion that effects traction of the spine while simultaneously offering therapeutic massage of the muscular tissue surrounding the spine.

Figure 20:
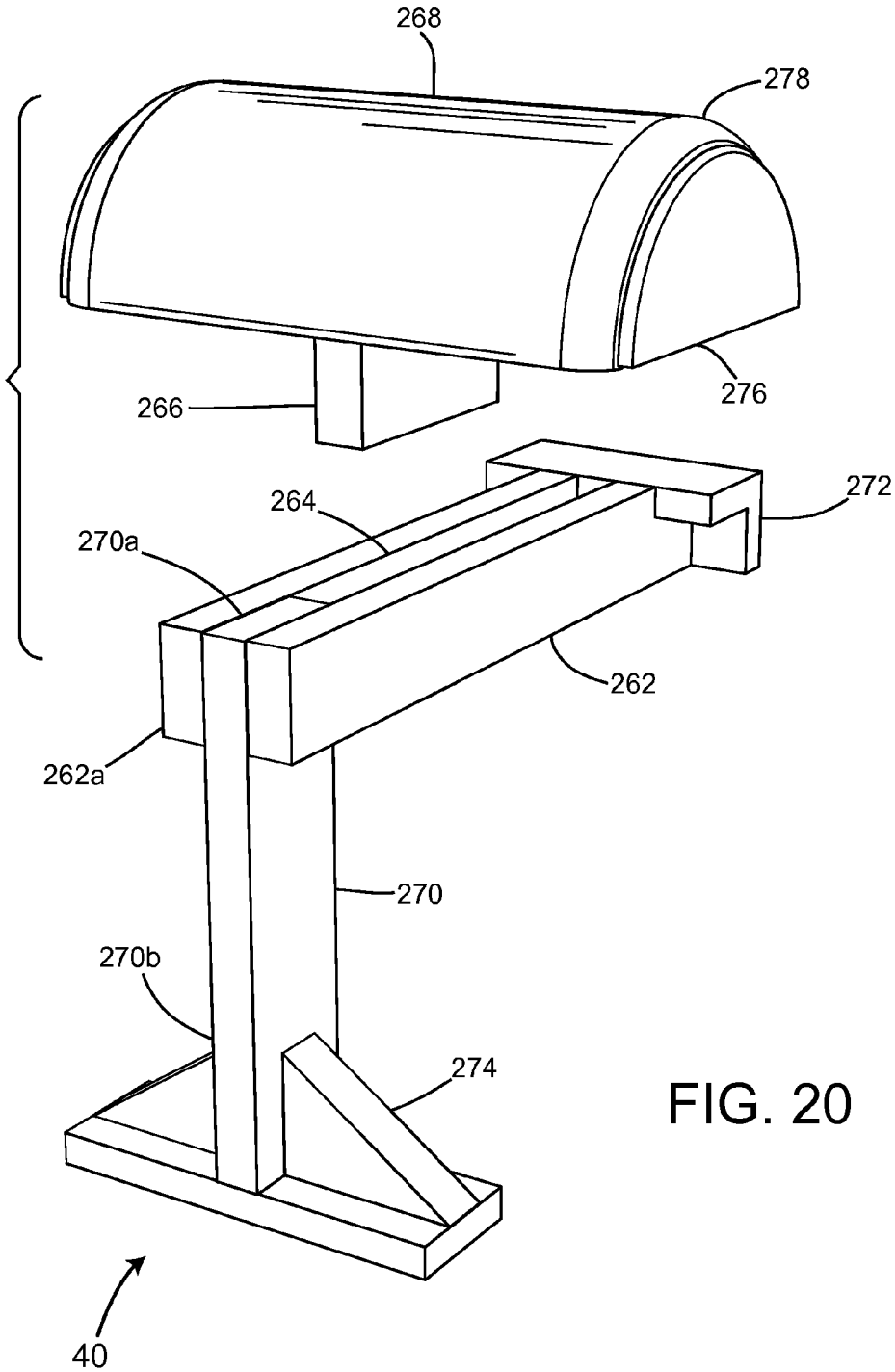
FIG. 20 is a front perspective view of the preferred embodiment of the present invention illustrating a leg rest with a moveable leg support.

The leg rest 40 primarily serves to accommodate the individual user's legs while he/she undergoes therapeutic treatment, but generally works alongside or complements the functionality of the adjustable lower support to facilitate varied forms of therapeutic treatments. The leg rest 40 in this regard, as generally depicted in FIG. 20, comprises a pair of horizontal structural members 262 that form a slot 264 for receiving therewithin a downward member 266 of a moveable leg support 268. Forward ends 262*a* of the horizontal structural members generally connect to a top end 270*a* of a support post 270 while rearward ends of the horizontal structural members connect to a brace member 272 suited for attachment to the frontward end member 32 of the structural base, below the forward side of the frame. A bottom-braced member 274 generally mounted to a bottom end 270*b* of the support post 270 offers to stabilize the leg rest 40 during operation. In furthering comfort to the individual user, a half-cylindrical shaped structure 276 of the moveable leg support 268, generally shown in FIG. 20 as being connected to the downward member 266, includes an upper pad 278 affixed thereto. In accommodating the particular instances of operation where the adjustable lower support varies in its position as described above, the forward side 22 of the frame incorporates within its structure a cut out 280 that is appropriately configured to accommodate the transition area between the individual user's buttock and legs while at rest atop the adjustable lower support 216 and leg rest 40, respectively, during therapeutic treatment, as generally shown in FIG. 1.

Figure 2:
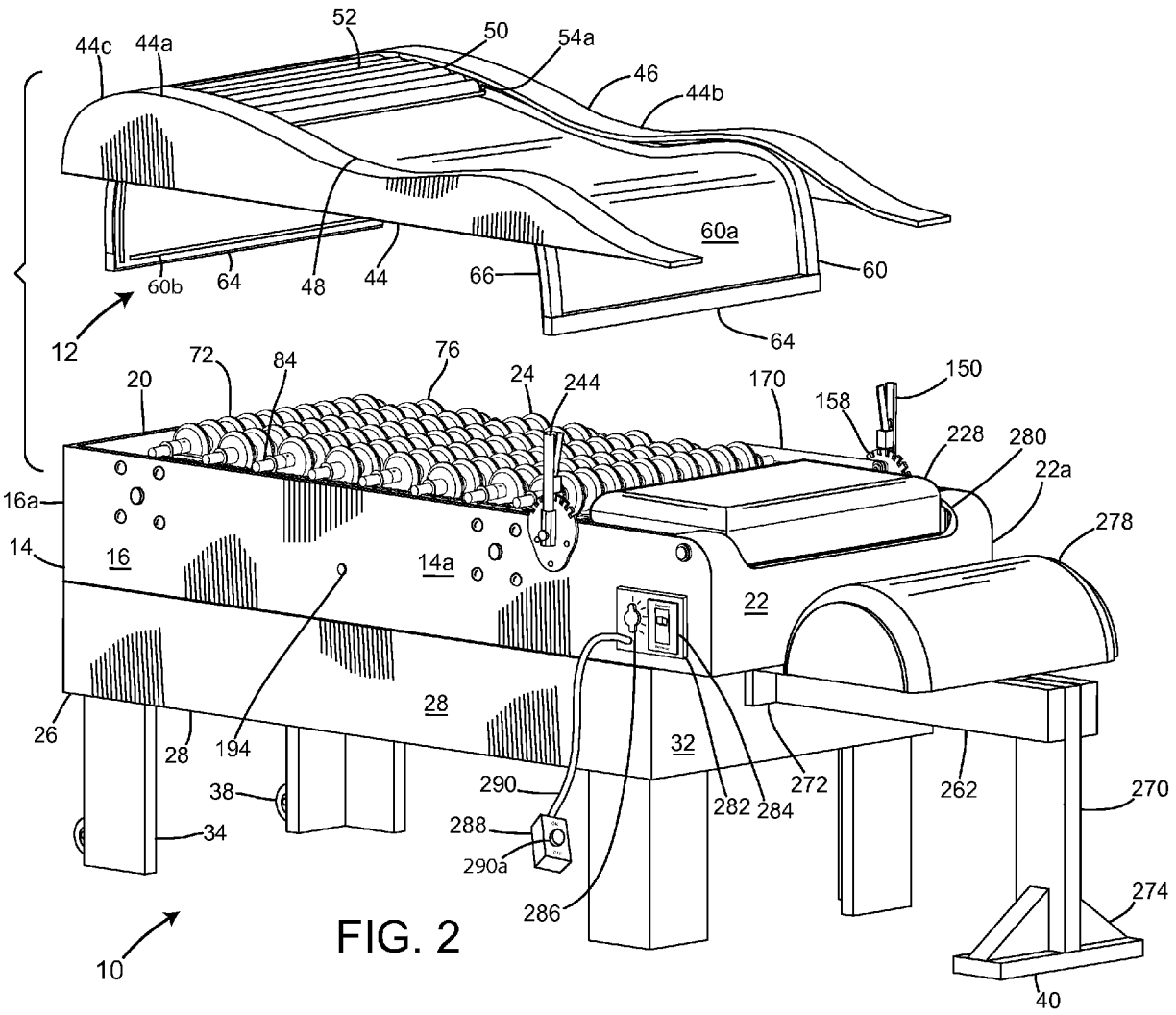
FIG. 2 is a right side perspective view of the preferred embodiment of the present invention illustrating an upper structure hovering above a frame being supported on a structural base, a leg rest connected to a frontward end member of the structural base, and a switch panel having selectable settings panel, a timer switch, and a moveable hand-held control.

In essence of its principal operation, the therapeutic apparatus designates the open portion 48 for accepting an individual user for therapeutic treatment. The individual user is preferably positioned upon his/her backside so as to comfortably rest upon the pliable material 60*b* incorporated within the structure of the inner protective shell 60, while the lobe and seat lever controls are preferentially held within sufficient reach of the individual user for minute adjustments before and during treatment. The moveable headrest 50 is adjusted appropriately to accommodate the individual user's head whereas the individual user's buttock and legs are respectively situated atop the adjustable lower support 216 and leg rest 40. In vicinity of the individual user's control is a switch panel 282 electronically coupled to the motor 104 for controlling its operation and consequently the movement of the roller assemblies. The switch panel is generally shown in FIG. 2 as comprising a selectable settings panel 284 for forward and reverse operational modes of the motor that accordingly sets the directional travel of the roller assemblies relatively around the segments and a timer switch 286 that sets the time duration for motor operation in preferred increments of five minutes. Optionally, the therapeutic apparatus may comprise a moveable hand-held control 288 generally connected to the switch panel by means of a pluggable extension cord 290 and having a button 290*a* designated for emergency stop or on-or-off functionality for motor activation or deactivation, respectively.

As discussed, the lobe lever control 150 mainly controls the angular position of the lobes by means of the leveraging action produced by the leveraging arms 180 on each of the fore and aft lobes. In this regard, a maximum forward positional setting of the lobe lever control 150 causes the fore lobes to reach their maximum angular position that will tend to allow the roller assemblies to effect increased therapeutic pressure generally within the area of the lumbar and sacral vertebrae. Conversely, a maximum backward positional setting of the lobe lever control causes the aft lobes to reach their maximum angular position that will tend to allow the roller assemblies to effect increased therapeutic pressure generally within the area of the thoracic and cervical vertebrae. Finally, a neutral positional setting of the lobe lever control will tend to orientate the bottom perimeter portions of the fore and aft lobes primarily along axis X as shown in FIG. 14A such to establish a centralized curvature in between the fore and aft lobes that generally effects uniform application of therapeutic pressure along the entire spinal column.

As generally recognized within the scope of operation, the therapeutic apparatus can conceivably offer various forms of therapeutic treatments to the individual user, generally of which depends on the individual user's bodily orientation while at rest upon the inner protective shell (e.g., side vs. back laying position), directional setting and speed of the roller assemblies, and positional setting of the fore and aft lobes of the rightward and leftward segments, adjustable lower support 216, and leg rest 40. As one example of the invention's versatility in terms of effecting increased traction on the spine, an individual user undergoing therapeutic treatment may simply alter the position or re-orientate his/her legs in a bent manner that allows the feet to generally rest atop the leg rest while the adjustable lower support is positioned to a forward and downward positional setting and by means of this orientation, the individual user can establish increased amounts of therapeutic pressure generally in vicinity of the pelvic region. Consequently, the pelvic region will tend to fall within a slight depression held in between the fore lobes and adjustable lower support, whereby the roller assemblies traveling downward and around the fore lobes will move the pelvic region generally downward and forward and inward and outward to simulate an oscillating, kneading action generally around the pelvic region that accordingly stretches and tracts the spinal column for resolution of back pain and other back-related aliments.

As it can be seen from the foregoing there is provided in accordance with this invention a simple and easily operated apparatus that is particularly suited to administer therapeutic pressure to specific bodily areas of the individual user that effectively and comprehensively resolves muscular aches and pains, including those that typically originate around and near the spinal column and surrounding posterior muscular tissue. It is obvious that the components comprising the therapeutic apparatus may be fabricated from a variety of materials, providing such selection or use of materials possess the capacity to withstand forces acting thereon throughout its duration of use in a commercial or residential setting. Accordingly, it is most desirable, and therefore preferred, to construct the upper structure, frame, structural base with legs, rightward and leftward segments, and leg rest 40 from wood or equivalent material to offer ease in machinability and fabrication and establish opportunities for compact shipping and onsite assembly. Other operable components, such as the driving and driven shafts 94, 96, internal and external drive chains 98, 100, sleeve and flange bearings, lever controls, motor 104, and linkage members, are generally offered and available in the art for adaptation and use in the present invention.

Although it is recognized that the present invention contemplates use of chains as a preferred form of conveying the roller assemblies, it is generally understood that alterative means for conveying the roller assemblies may be incorporated within the scope of the present invention without adversely affecting its overall performance, such as a belt combined with a configured adapter suited to accept ends of the roller shaft 78, for example. Equally, the flexible guide rails 74, each generally in the form of a planar metallic strap screw mounted to select perimeter portions of the lobes, may comprise alternative geometries, such as concave- or convex-shaped channel, that generally conforms to and accepts an equally configured portion of a sleeve bearing or a slide mechanism that is appropriately fitted to the roller shaft's end, for example.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

The invention claimed is:

1. A therapeutic apparatus for therapeutically treating an individual user, said apparatus comprising, in combination:

a frame having rightward and leftward sides connecting to rearward and forward sides to substantially form a boxed structure;

an inner working assembly positioned and supported interiorly within said frame and having leftward and rightward segments and a plurality of roller assemblies, said leftward and rightward segments each having fore and aft lobes primarily connected together by a hinge mechanism and in part by a flexible guide rail;

roller propulsion means for propelling in unison said roller assemblies relatively over and about said flexible guide rails mounted to said fore and aft lobes of the leftward and rightward segments; and a lever linkage assembly for independently manipulating the angular position of said fore and aft lobes relatively about said hinge mechanism.

2. An apparatus as set forth in claim 1, further comprising an adjustable lower support mounted to said frame and having a seat lever control for adjusting said adjustable lower support relatively downward and forward from said fore lobes to allow said roller assemblies to generally effect an upward and downward and inward and outward movement of the individual user's pelvis.

3. An apparatus as set forth in claim 2, wherein said adjustable lower support comprises a seat assembly and a platform assembly having a pair of parallel-positioned support bars suited for attaching thereto said seat assembly, said parallel-positioned support bars each having an end connected to a first end of an upward link, said upward link having a second end connected to an outward shaft substantially being positioned to align with said parallel-positioned support bar and said upward link, said outward shaft being slidably fitted with a sleeve bearing configured for mounting into said frame, said seat assembly having a padded seat and a pair of cylindrical sleeves slidably mounted to said parallel-positioned support bars and connected together by a pair of inner brace members substantially suited to mount said padded seat atop thereof, said seat lever control having a pivoting handle with a spring-loaded moveable locking latch for engaging one of a series of notches present on a mounting plate attached to said frame, said pivoting handle having a cylindrical aperture for receiving therewithin a portion of one of said outward shafts.

4. An apparatus as set forth in claim 1, further comprising an inner protective shell positioned interiorly within said frame above said inner working assembly and having a structural frame for attaching thereto a pliable material suited in protecting the individual user.

5. An apparatus as set forth in claim 1, further comprising a structural base having a pair of lengthened side members connecting to backward and frontward end members to substantially form a boxed structure for supporting said frame generally above ground level.

6. An apparatus as set forth in claim 5, further comprising a tensioner assembly having biasing means, a pair of outward support bars each having first and second ends, and a bar having a pair of outward ends each being fitted with an idle sprocket and hub assembly and connected to said first end of the outward support bar, said second ends of the outward support bars being connected to said frame, said biasing means being connected to said outward support bars and said structural base.

7. An apparatus as set forth in claim 5, further comprising a leg rest having a moveable leg support equipped with a downward member, a support post having top and bottom ends, and a pair of horizontal structural members held in a parallel arrangement with each other to form a slot for receiving therewithin said downward member of the moveable leg support, said horizontal structural members having forward ends connecting to said top end of the support post and rearward ends connecting to a brace member substantially configured for attachment to said structural base, said bottom end of the support post being connected to a bottom-braced member for stabilizing said leg rest during operation.

8. An apparatus as set forth in claim 1, further comprising an upper structure mounted atop of said frame and having a pair of sidewalls each having an upper leading edge for connecting thereto a top, said top having an open portion designated for receiving the individual user for therapeutic treatment.

9. An apparatus as set forth in claim 1, wherein said roller propulsion means comprises a motor having an output shaft, driving and driven shafts, a pair of internal drive chains substantially suited for attaching thereto said roller assemblies and operably linking together said driving and driven shafts, and an external drive chain operably linking together a drive end of the driving shaft with said output shaft of the motor.

10. An apparatus as set forth in claim 9, further comprising a switch panel having a selectable settings panel for forward and reverse operational modes of said motor to accordingly set the directional travel of said roller assemblies relatively over said flexible guide rails attached to said segments and a timer switch for setting the time duration for operation of said motor.

11. An apparatus as set forth in claim 9, wherein said driving and driven shafts each comprises a pair of hub and sprocket assemblies operating conjunctively with said internal drive chains and a pair of sectional ends each passing into a four-bolt flange bearing mounted interiorly to said frame.

12. An apparatus as set forth in claim 11, wherein said fore and aft lobes of the leftward and rightward segments comprise a perimeter portion for attaching said flexible guide rail and shaft apertures for accepting and passing therethrough said driving and driven shafts.

13. An apparatus as set forth in claim 1, wherein said fore and aft lobes of the leftward and rightward segments each comprises inward and outward sides and hinge apertures extending therethrough, said inward and outward sides each comprises a recessed portion in vicinity of said hinge aperture.

14. An apparatus as set forth in claim 13, wherein said hinge mechanism comprises a pair of planar elements each being mounted in an opposing relation to one another within said recessed portions of the inward and outward sides and having a pair of ends fitted with apertures selectively arranged to align with said hinge apertures of the fore and aft lobes for accommodating therewithin a fastener.

15. An apparatus as set forth in claim 1, wherein said lever linkage assembly comprises a leveraging rod having an end portion, a lobe lever control having a pivoting handle with a spring-loaded moveable locking latch for engaging one of a series of notches present on a mounting plate attached to said frame, and first, second, third, fourth, and offsetting linkage members each having first and second ends, said pivoting handle having a cylindrical aperture for accepting therewithin a shaft having an end portion connected to said first end of the first linkage member, said second end of the first linkage member being connected to said first end of the second linkage member, said second end of the second linkage member being connected to said first end of the offsetting linkage member, said second end of the offsetting linkage member being connected to said first end of the third linkage member, said second end of the third linkage member being connected to said first end of the fourth linkage member, said second end of the fourth linkage member being connected to said end portion of the leveraging rod.

16. An apparatus as set forth in claim 15, wherein said leveraging rod comprises a pair of leveraging arms each of elongate, planar form and fixedly attached thereto in vicinity of said hinge mechanism connecting together said fore and aft lobes of each of the leftward and rightward segments, said leveraging arms each having frictional minimizing means for minimizing the frictional interaction while said leveraging arms leverage upon said fore and aft lobes for angular positioning.

17. An apparatus as set forth in claim 16, wherein said leveraging arm comprises a slotted section and top and bottom surfaces, said frictional minimizing means comprises a pair of sleeves fixedly attached to said bottom surface of the leveraging arm substantially on each side of said slotted section and a wheel slidably mounted onto a shaft extending through said sleeves.

18. An apparatus as set forth in claim 1, wherein said roller assemblies each comprises a plurality of individual rollers mounted on a roller shaft and spaced equally apart from one another by a spacer, said roller shaft having a pair of ends each fitted with a sleeve bearing to engage with and travel relatively over said flexible guide rail.

19. An apparatus as set forth in claim 1, wherein said roller assemblies comprises an alternating arrangement of first and second roller shafts respectively fitted with an even number of individual rollers spaced equally apart from one another by spacers and an odd number of individual rollers spaced equally apart from one another by spacers to fulfill a staggered relationship among said individual rollers mounted on said first and second roller shafts, said first and second roller shafts each having a pair of ends each fitted with a sleeve bearing to engage with and travel relatively over said flexible guide rail.

20. A therapeutic apparatus for therapeutically treating an individual user, said apparatus comprising, in combination:

a frame having rightward and leftward sides connecting to rearward and forward sides to substantially form a boxed structure;

an upper structure mounted atop of said frame and having a pair of sidewalls each having an upper leading edge for connecting thereto a top, said top having an open portion designated for receiving the individual user for therapeutic treatment;

an inner working assembly positioned and supported interiorly within said frame and having leftward and rightward segments and a plurality of roller assemblies, said leftward and rightward segments each having fore and aft lobes primarily connected together by a hinge mechanism and in part by a flexible guide rail;

roller propulsion means for propelling in unison said roller assemblies relatively over and about said flexible guide rails mounted to said fore and aft lobes of the leftward and rightward segments;

a lever linkage assembly for independently manipulating the angular position of said fore and aft lobes relatively about said hinge mechanism;

an adjustable lower support mounted to said rightward and leftward sides of the frame and having a seat lever control for adjusting said adjustable lower support relatively downward and forward from said fore lobes to allow said roller assemblies to generally effect an upward and downward and inward and outward movement of the individual user's pelvis; and a structural base having a pair of lengthened side members connecting to backward and frontward end members to substantially form a boxed structure for supporting said frame generally above ground level.

21. An apparatus as set forth in claim 20, wherein said roller propulsion means comprises a motor having an output shaft, driving and driven shafts, a pair of internal drive chains substantially suited for attaching thereto said roller assemblies and operably linking together said driving and driven shafts, and an external drive chain operably linking together a drive end of the driving shaft with said output shaft of the motor, said driving and driven shafts each having a pair of hub and sprocket assemblies operating conjunctively with said internal drive chains and a pair of sectional ends each passing into a four-bolt flange bearing mounted interiorly to said rightward and leftward sides of the frame.

22. An apparatus as set forth in claim 20, further comprising a tensioner assembly having biasing means, a pair of outward support bars each having first and second ends, and a bar having a pair of outward ends each being fitted with an idle sprocket and hub assembly and connected to said first end of the outward support bar, said second ends of the outward support bars being connected to said frame, said biasing means being connected to said outward support bars and said structural base.

23. A therapeutic apparatus for therapeutically treating an individual user, said apparatus comprising, in combination:

a frame having rightward and leftward sides connecting to rearward and forward sides to substantially form a boxed structure;

an upper structure mounted atop of said frame and having a pair of sidewalls each having an upper leading edge for connecting thereto a top, said top having an open portion designated for receiving the individual user for therapeutic treatment;

an inner working assembly positioned and supported interiorly within said frame and having leftward and rightward segments and a set of roller assemblies, said leftward and rightward segments each having fore and aft lobes primarily connected together by a hinge mechanism and in part by a flexible guide rail, said fore and aft lobes of the leftward and rightward segments each having a perimeter portion for attaching said flexible guide rail, inward and outward sides, and hinge and shaft apertures extending therethrough, said inward and outward sides each having a recessed portion in vicinity of said hinge aperture, said hinge mechanism having a pair of planar elements each being mounted in an opposing relation to one another within said recessed portions of the inward and outward sides and having a pair of ends fitted with apertures selectively arranged to align with said hinge apertures of the fore and aft lobes for accommodating therewithin a fastener;

an inner protective shell positioned interiorly within said frame above said inner working assembly and having a structural frame for attaching thereto a pliable material suited in protecting the individual user;

roller propulsion means for propelling in unison said roller assemblies relatively over and about said flexible guide rails mounted to said fore and aft lobes of the leftward and rightward segments;

a lever linkage assembly for independently manipulating the angular position of said fore and aft lobes relatively about said hinge mechanism;

an adjustable lower support mounted to said rightward and leftward sides of the frame and having a seat lever control for adjusting said adjustable lower support relatively downward and forward from said fore lobes to allow said roller assemblies to generally effect an upward and downward and inward and outward movement of the individual user's pelvis;

a structural base having a pair of lengthened side members connecting to backward and frontward end members to substantially form a boxed structure for supporting said frame generally above ground level; and a tensioner assembly having biasing means, a pair of outward support bars each having first and second ends, and a bar having a pair of outward ends each being fitted with an idle sprocket and hub assembly and connected to said first end of the outward support bar, said second ends of the outward support bars being connected to said rightward and leftward sides of the frame, said biasing means being connected to said outward support bars and said lengthened side members of the structural base.

24. An apparatus as set forth in claim 23, wherein said roller assemblies comprises an alternating arrangement of first and second roller shafts respectively fitted with an even number of individual rollers spaced equally apart from one another by spacers and an odd number of individual rollers spaced equally apart from one another by spacers to fulfill a staggered relationship among said individual rollers mounted on said first and second roller shafts, said first and second roller shafts each having a pair of ends each fitted with a sleeve bearing to engage with and travel relatively over said flexible guide rail.

25. An apparatus as set forth in claim 23, wherein said roller propulsion means comprises a motor having an output shaft, driving and driven shafts, a pair of internal drive chains substantially suited for attaching thereto said roller assemblies and operably linking together said driving and driven shafts, and an external drive chain operably linking together a drive end of the driving shaft with said output shaft of the motor, said driving and driven shafts each comprises a pair of hub and sprocket assemblies operating conjunctively with said internal drive chains and a pair of sectional ends each passing into a four-bolt flange bearing mounted interiorly to said rightward and leftward sides of the frame, said driving shaft being positioned in vicinity of and passing through said shaft apertures of the fore lobes of the leftward and rightward segments and said driven shaft being positioned in vicinity of and passing through said shaft apertures of the aft lobes of the leftward and rightward segments.

26. An apparatus as set forth in claim 23, further comprising a leg rest having a moveable leg support equipped with a downward member, a support post having top and bottom ends, and a pair of horizontal structural members held in a parallel arrangement with each other to form a slot for receiving therewithin said downward member of the moveable leg support, said horizontal structural members having forward ends connecting to said top end of the support post and rearward ends connecting to a brace member substantially being configured for attachment to said structural base, said bottom end of the support post being connected to a bottom-braced member for stabilizing said leg rest during operation.

* * * * *